US007281724B1

(12) United States Patent
Larson

(10) Patent No.: US 7,281,724 B1
(45) Date of Patent: Oct. 16, 2007

(54) WHEELED WORK CHAIR

(76) Inventor: John E. Larson, P.O. Box 1197, Hamilton, MT (US) 59840

( * ) Notice: Subject to any disclaimer, the term of this patent is extended or adjusted under 35 U.S.C. 154(b) by 515 days.

(21) Appl. No.: 10/973,763

(22) Filed: Oct. 25, 2004

Related U.S. Application Data

(60) Provisional application No. 60/513,787, filed on Oct. 23, 2003, provisional application No. 60/513,788, filed on Oct. 23, 2003.

(51) Int. Cl.
*A47C 1/00* (2006.01)

(52) U.S. Cl. ..... 280/250.1; 280/47.41; 280/43; 297/344.18

(58) Field of Classification Search ..... 280/242.1, 280/250.1, 638, 47.38, 47.4, 47.41, 43, 647, 280/650; 297/344.18, 344.19, 344.12, 344.1, 297/302.1, 300.1
See application file for complete search history.

(56) References Cited

U.S. PATENT DOCUMENTS 4,779,881 A * 10/1988 Baker ..... 280/242.1
5,480,172 A 1/1996 James
6,024,369 A * 2/2000 Goldstein et al. ..... 280/248
6,155,583 A * 12/2000 Koike ..... 280/250.1
6,247,718 B1 * 6/2001 Gobbers et al. ..... 280/304.1
6,325,399 B1 * 12/2001 DeMoss ..... 280/250.1
6,419,260 B1 * 7/2002 Kuroda ..... 280/647
6,454,286 B1 * 9/2002 Hosino ..... 280/250.1
6,793,232 B1 * 9/2004 Wing ..... 280/304.1
6,916,032 B2 * 7/2005 Wong ..... 280/244
7,040,641 B2 * 5/2006 Wing ..... 280/304

OTHER PUBLICATIONS

Series 200 work chair ; Date Unknown; 2 pgs.; www.rvseuroflex.se/runtime/home/html/Produkter/arbetssol%10200.htm.

* cited by examiner

*Primary Examiner*—Christopher P. Ellis
*Assistant Examiner*—Brian Swenson

(57) ABSTRACT

A wheel work chair has all the attributes and style of an office chair but is equipped with wheelchair-type supporting wheels The chair is height adjustable with the upper portion of the chair moving relative to the lower portion of the chair. Wheels connected to the upper portion of the chair move with the chair seat as the height of the chair is adjusted. Wheels connected to the lower portion of the chair remain on the ground as the height of the chair is adjusted. A static surface is provided on the arm of a height adjustable chair to support the weight of a user while that chair is being raised.

57 Claims, 20 Drawing Sheets

WHEELED WORK CHAIR

CROSS-REFERENCE TO RELATED APPLICATIONS

The subject application claim the benefits of U.S. Provisional Application Ser. No. 60/513,787, filed Oct. 23, 2003 and U.S. Provisional Application Ser. No. 60/513,788, filed Oct. 23, 2003. These applications are herein incorporated by reference in their entirety.

BACKGROUND OF THE INVENTION

Modern work chairs are ergonomically designed with the primary objective of preventing health problems resulting from inappropriate postural positioning of the seated worker, and also the numerous health problems resulting from static work postures over an extended period of time. Many of the remedies afforded by these ergonomic innovations involve either active or passive adjustments for selectively changing the postural positioning by the seated worker. Oftentimes ergonomic posture positioning adjustments have the added advantage of fitting the chair to multiple users having different body measurements, and also of allowing individual users the adjustment options for working at various height work surfaces. Similarly, these chair adjustments oftentimes allow seated workers to adjust their chairs for access to various height-placed work objects such as microscopes set on high counters for part of the work day, and then for example, a keyboard set at a much lower height for another part of the work day. Height adjustment is the most often used chair adjustment in the seated workplace.

Also, modern work chairs have been continually designed and redesigned to make them comfortable for seated workers, as worker comfort translates to worker productivity. Modem work chairs now offer seats of breathable fabrics, lumbar supports, sculpted seat cushions, and adjustable backrests and footrests. Modern work chairs provide many of these features while maintaining a sleek and attractive overall design.

Persons confined to a wheelchair experience more health problems relating to postural stasis than ordinary seated workers, and seldom are able to utilize any of the ergonomic benefits, or stylish design attributes afforded ordinary workers in the seated workplace. A wheelchair-type chair with the ergonomic innovations and design attributes of a modern work chair would offer a user approximately the same health and comfort benefits as those provided an ordinary seated worker, while providing conformity with the style and design of the overall workplace environment.

All patents, patent applications, provisional patent applications and publications referred to or cited herein, are incorporated by reference in their entirety to the extent they are not inconsistent with the explicit teachings of the specification.

SUMMARY OF THE INVENTION

The invention involves a wheeled work chair. The chair can gave the ergonomic functions and style of a modern work chair yet be equipped with wheelchair-type supporting wheels. This allows a disabled person to move about a workplace without use of his or her feet. In a preferred embodiment, the chair is height adjustable with the upper portion of the chair moving relative to the lower portion of the chair, with the wheels attached to the upper portion. In this embodiment, the wheels move with the chair seat as the height of the chair is adjusted, thus allowing the seat to spin about in concert with the wheels. This allows the user to benefit from the swivel features of modern work chairs without the typical problem that would be experienced with standard wheelchairs, that being the bumping of user's legs into stationary wheels during chair seat spin. In one embodiment where the wheels are connected to the lower portion of the wheeled work chair, approximately the same swivel limitations as standard wheelchairs exist, because as the wheels remain stationary on the ground whether the height of the chair is adjusted or not, the user's legs would swivel into the stationary wheels, unless the chair seat were adjusted high enough over the wheels to clear obstruction with the stationarily grounded wheels. In a particularly preferred embodiment of the wheeled work chair, whether the wheels are secured to the upper portion or the lower portion, a pair of push-off arm rests are provided allowing the user to transfer her or his weight from the chair seat making up the upper portion of the chair, to the base making up the lower portion of the chair. This allows an assistant to raise the chair seat, or add an additional seat cushion without user evacuation from the chair. In a most preferred embodiment, a remote actuator is provided proximate one of the push-off arm rests which allows the user to raise the chair seat without using his or her feet, without evacuating the chair, and without assistance from another person. An example of benefitting from this most preferred embodiment is that a worker confined to a chair can move herself or himself from a desk work area, over to a copy machine, and raise himself or herself to a height required to operate the copy machine without assistance from another person. In a home or community environment, this most preferred embodiment would allow a user to reach and access many essential objects that might otherwise be impossible in a standard wheelchair. This most preferred embodiment is also helpful in assisting the user to transfer from the wheeled work chair to a bathtub, another chair, into a car seat, or onto a bed. In an hospital or nursing home environment, this most preferred embodiment would serve to assist a healthcare worker, or the user, independent of a healthcare worker, into a height positioned bed or gurney. In an other version of this most preferred embodiment, a second remote actuator is mounted on the upper portion of the wheeled work chair allowing a user to adjust the chair downward. In yet another version, any number of remote actuators can be mounted on upper portion armrests for actuating seat tilt, back tilt, footrest adjustments, or any other ergonomic mechanisms the wheeled work chair might provide.

DETAILED DESCRIPTION OF THE INVENTION

The subject invention provides a wheelchair without the traditional frame. The wheeled work chair of the subject invention provides the ergonomic benefits, comfort, and style of a conventional office chair.

The subject invention has a lower portion and an upper portion that can move relative to the lower portion. The subject invention has an height adjustment mechanism 11 supported on the lower portion which supports and moves a seat support mechanism to adjustable heights. The seat support mechanism positionally supports a chair seat.

The subject chair has wheelchair-type wheels mounted to a chair. The chair is height adjustable to adapt to different task ergonomic configurations. An upper portion moves relative to the lower portion of the chair. Wheels mounted on the stationary, lower portion do not rise on height adjustment. Wheels mounted on the upper moving portion rise with the chair seat and leave the ground as the chair is adjusted upward. To accomplish height adjustment for a seated person who is unable to use their legs the subject chair can be fitted with a push-off arm rest supporting mechanism. The push-off arm rest supporting mechanism 42 is stationarily supported directly by the lower portion allowing a person to transfer their body weight with their arms to the lower portion thereby allowing the seat to be raised.

Figure 14:
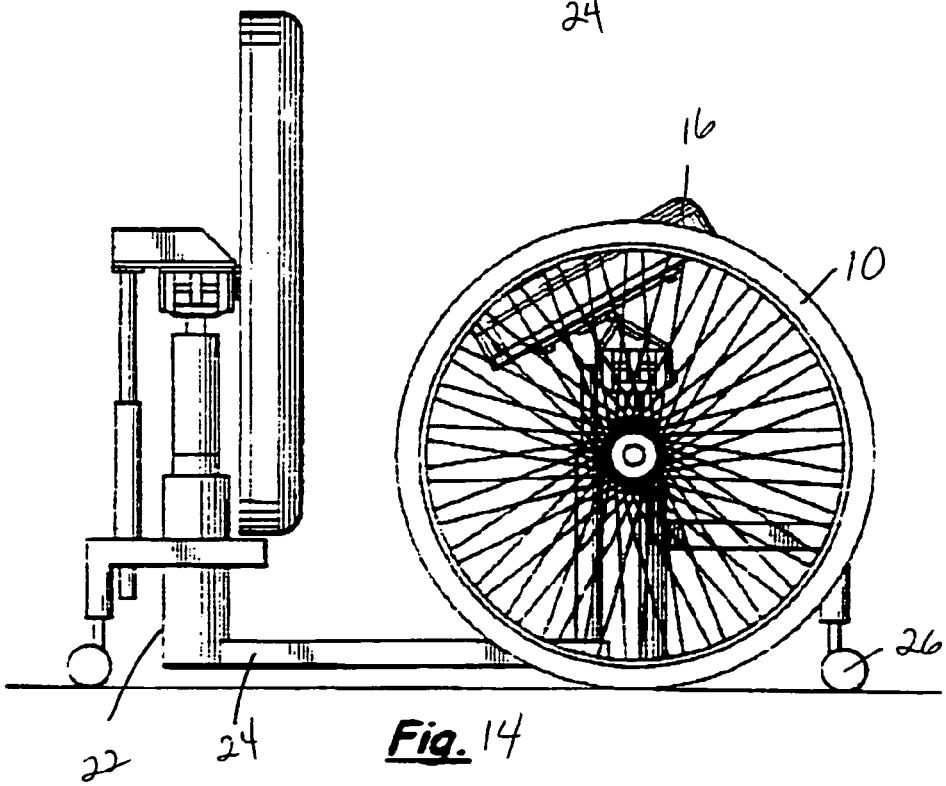
FIG. 14 shows a side view of the wheeled work chair shown in FIG. 12 with the wheels connected to the lower portion of the chair.

A preferred embodiment of the chair of the subject invention is shown in FIGS. 14. In this embodiment, the wheels 10 are mounted on the upper portion 12 of the chair. Therefore, when the height of the chair is adjusted upward, the wheels rise off the ground. The upper portion comprises a seat support mechanism 14 and a chair seat 16. The upper portion can further include a seat back 18 and arms 20. The upper portion 12 moves relative to the lower portion 22. The lower portion 22 includes a base 24 with at least three castors 26 which contact the floor. A swivel 27 can be included in the lower portion 22 to allow the push-off arm rest supporting mechanism to rotate.

Wheels are attached to the chair by a wheel supporting mechanism 28. Wheel support members 30, 32 connect to the upper portion 12 or lower portion 22 of the chair and extend in opposite directions from each other. A first end 34, 36 of each wheel support member 30, 32, respectively, attaches to the chair. A second end 38, 40 of each wheel support member 30, 32, respectively, receives the wheels 10. The wheels rotate substantially parallel to each other and cannot swivel in relationship to one another.

In a particularly preferred embodiment, the wheeled work chair of the subject invention has a push-off arm rest supporting mechanism 42 that includes a pair of push-off arm rests 56, 58 which allows one seated on the chair to use for lifting their weight off the chair seat 16 so the seat can be raised. The push-off arm rest supporting mechanism is attached to the lower portion 22. The push-off arm rest supporting mechanism 42 includes push-off arm rest supports 44, 46. A first end 48, 50 of each support 44, 46 respectively, is secured to the lower portion 22. A second end 52, 54 of each support 44, 46 has push-off arm rests 56, 58. The push-off arm rests do not rise with the upper portion of the chair as the upper portion rises. The push-off arm rests can be detachable. Slots 59 allow upper portion components attached to the push-off arm rest supports to rise as the upper portion rises.

Figure 1:
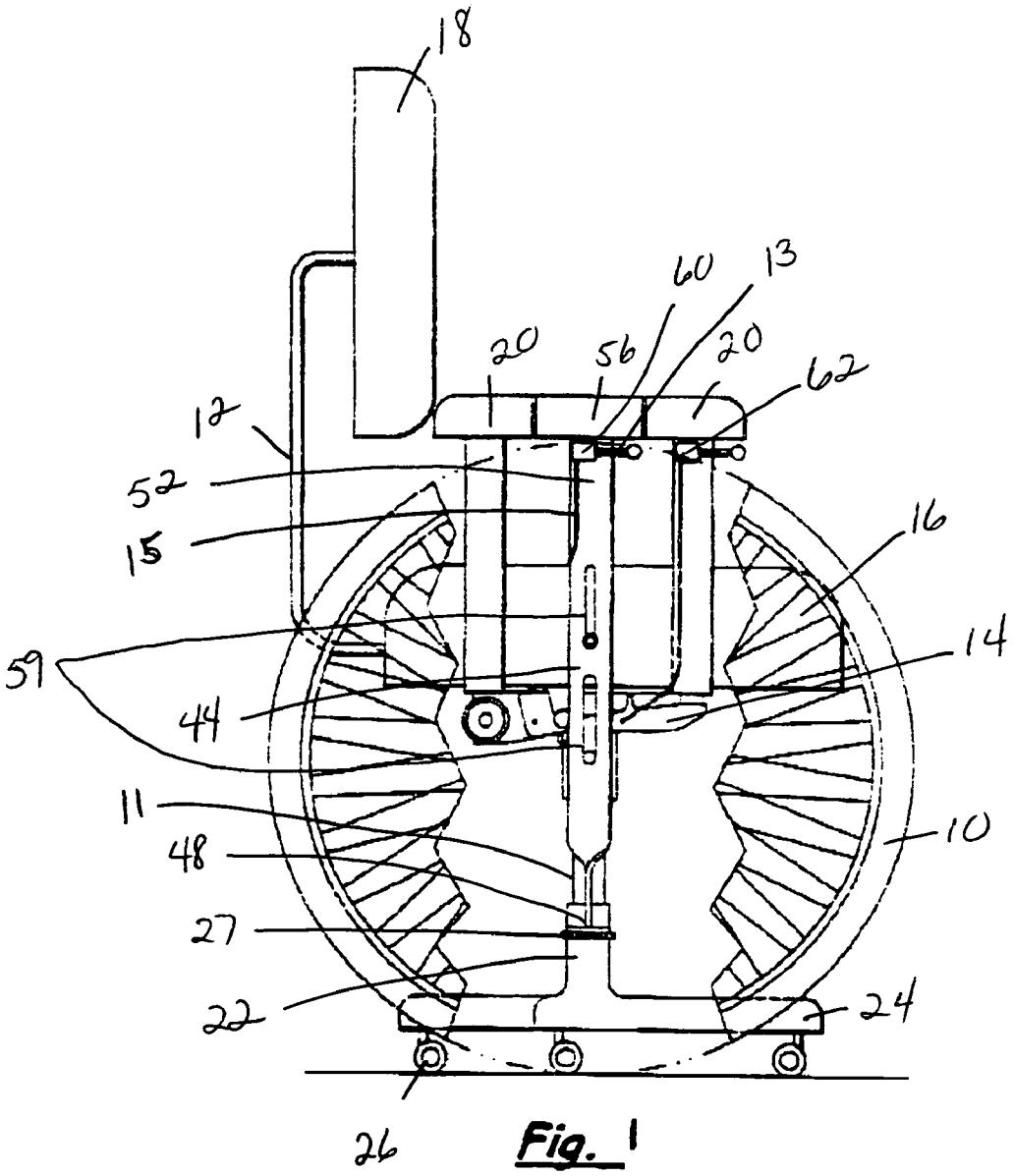
FIG. 1 shows a side view of a preferred embodiment of the wheeled work chair of the subject invention with the wheels connected to the upper portion of the chair.

In the embodiment shown in FIG. 1, an actuation mechanism 60 locks and unlocks the height adjustment mechanism which controls movement of the upper portion 12 relative to the lower portion 22. The actuation mechanism 60 can be any type suitable to control the height adjustable mechanism. In this embodiment, the height adjustment mechanism 11 is a telescoping support mechanism 61 with an upper section 63 and a lower section 65 which move in parallel alignment and can be locked into position or unlocked for height adjustments. The actuation mechanism 60 controlling movement of these sections in this embodiment is a remote actuation mechanism using a lever 13 and a cable 15. An additional actuator 62 is shown on the chair in FIG. 1 and controls the tilt and positioning of the seat 16 and seat back 18.

Figure 2:
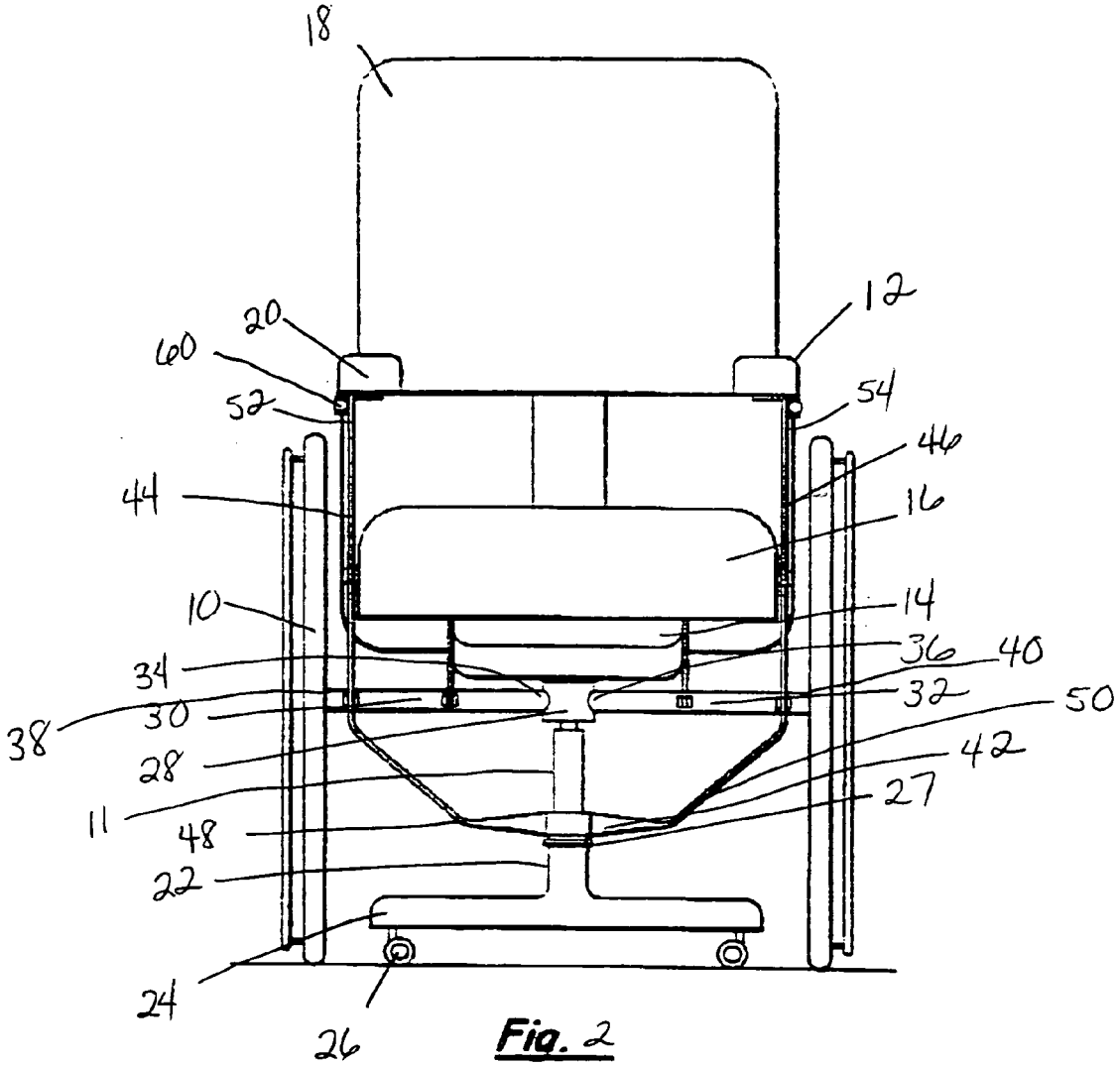
FIG. 2 shows a front view of the wheeled work chair shown in FIG. 1.
Figure 3:
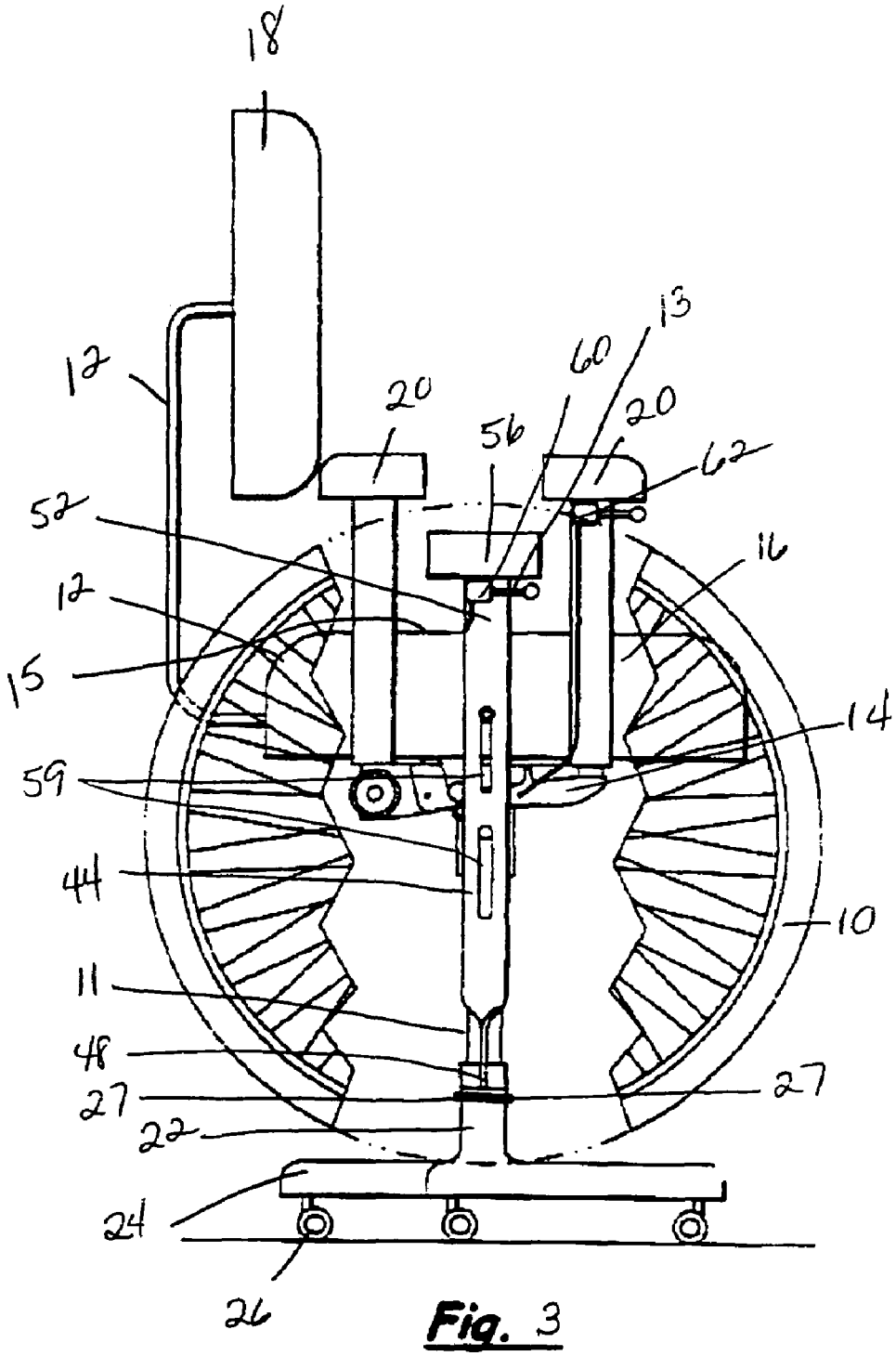
FIG. 3 shows a side view of the wheeled work chair shown in FIG. 1 where the height of the chair has been adjusted upward.
Figure 4:
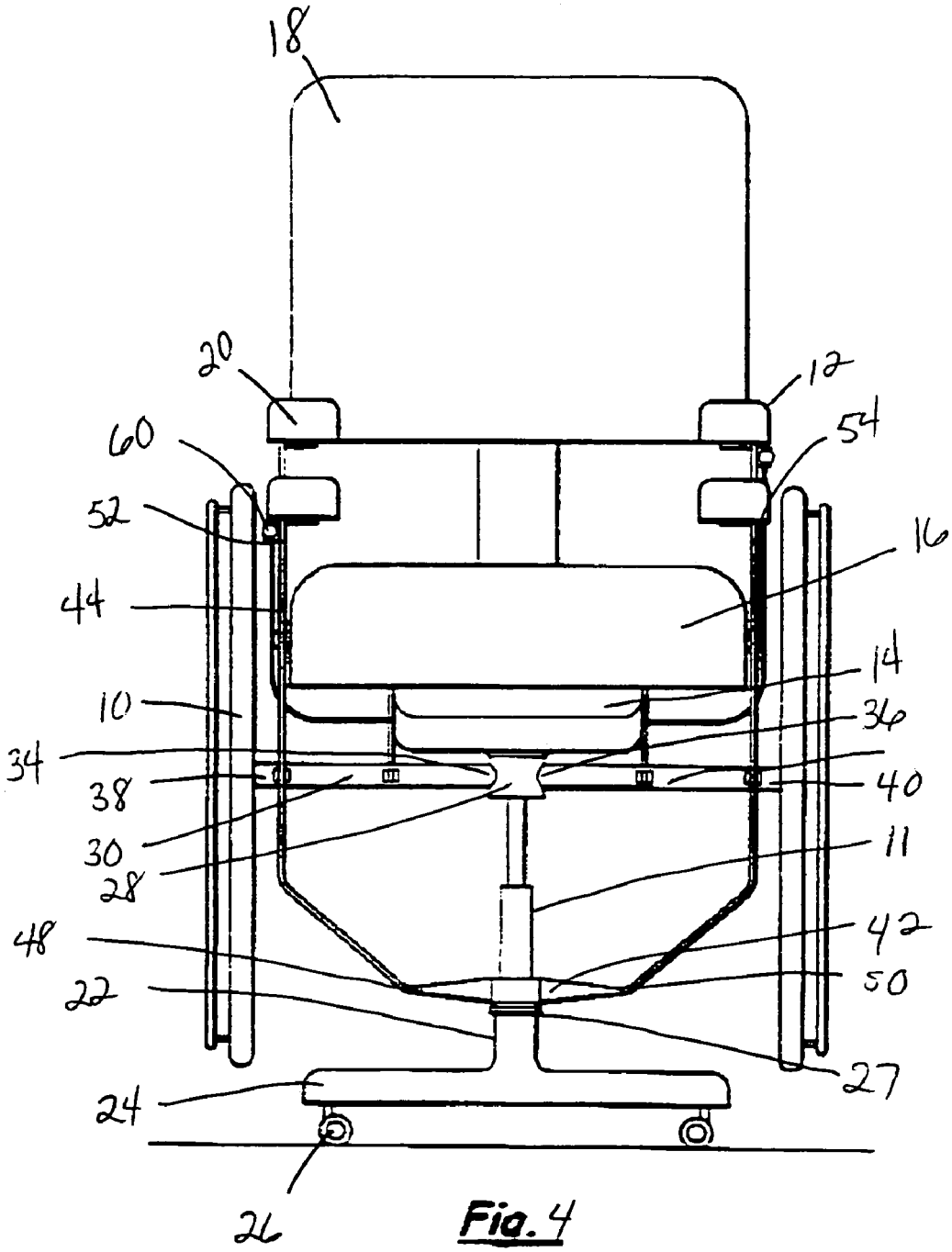
FIG. 4 shows a front view of the wheeled work chair shown in FIG. 1 where the height of the chair has been adjusted upward.

As previously stated, FIGS. 1-4 show a preferred embodiment of the subject chair with the wheels mounted on the upper moving portion. FIG. 1 shows a side view of the chair with the wheels 10 on the ground. FIG. 2 shows a front view of the same chair in that position. FIG. 3 shows a side view of the subject chair where the seat has been raised. The upper portion 12 of the chair including the seat support mechanism 14, the seat 16, the seat back 18, arms 20 and wheels 10 have moved within the slots 59 and away from the lower portion 22. With the wheels 10 raised off the ground the chair seat can swivel.

Figure 5:
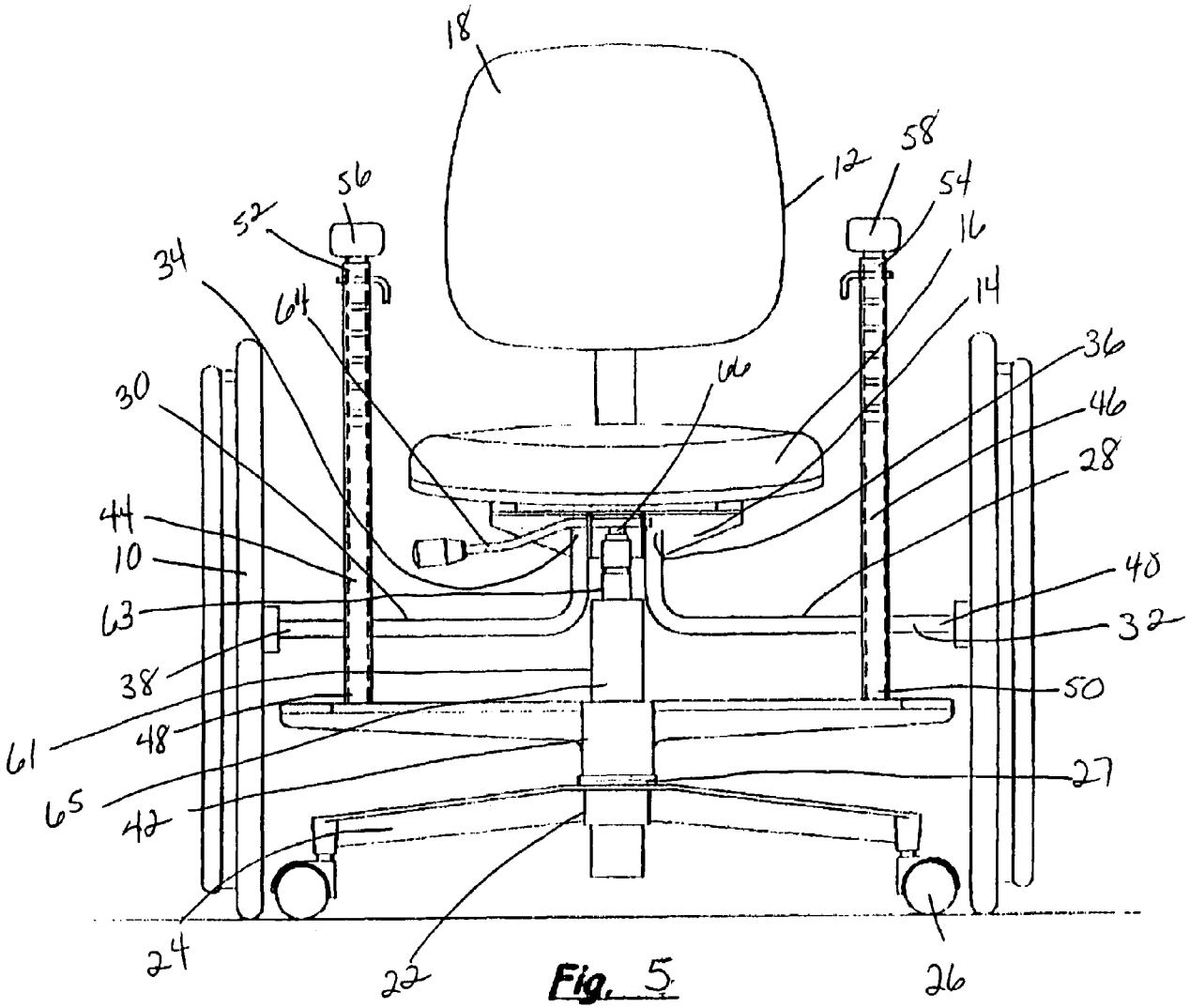
FIG. 5 shows a front view of another preferred embodiment of the wheeled work chair of the subject invention that has adjustable push-off arm rests.
Figure 6:
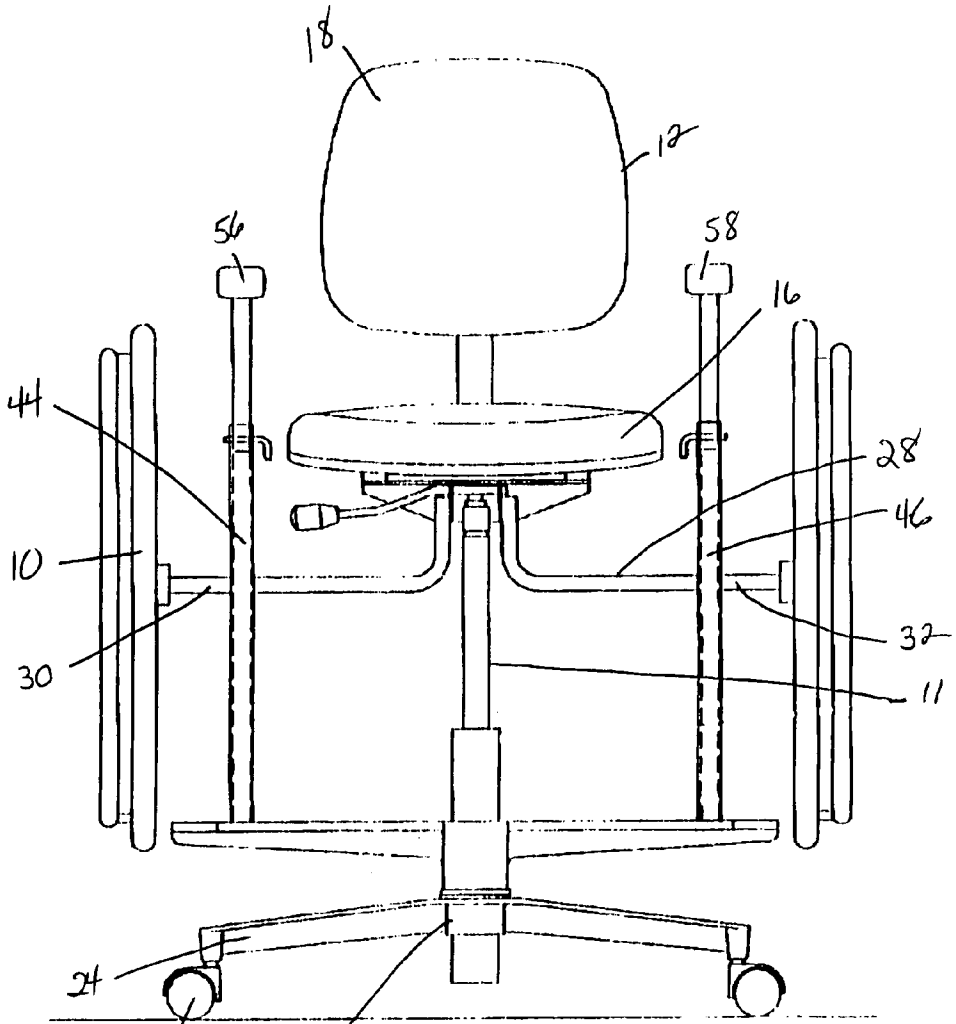
FIG. 6 shows a front view of the wheeled work chair shown in FIG. 5 where the height of the chair has been adjusted upward.

FIG. 5 shows another preferred embodiment of the wheeled work chair of the subject invention. The wheels 10 like the wheels on the chair in FIG. 1 are connected to the upper moving portion 12 of the chair. FIG. 5 shows the wheels on the ground. FIG. 6 shows the chair seat raised and the wheels off the ground. An actuation mechanism 64 is a lever that contacts an actuation button 66 on a telescoping support mechanism 61 to raise and lower the chair seat 16. The telescoping support mechanism can be supported by a stand tube 67. In this embodiment, the push-off arm rest supports 44, 46 are height adjustable and can be raised or lowered.

Figure 7:
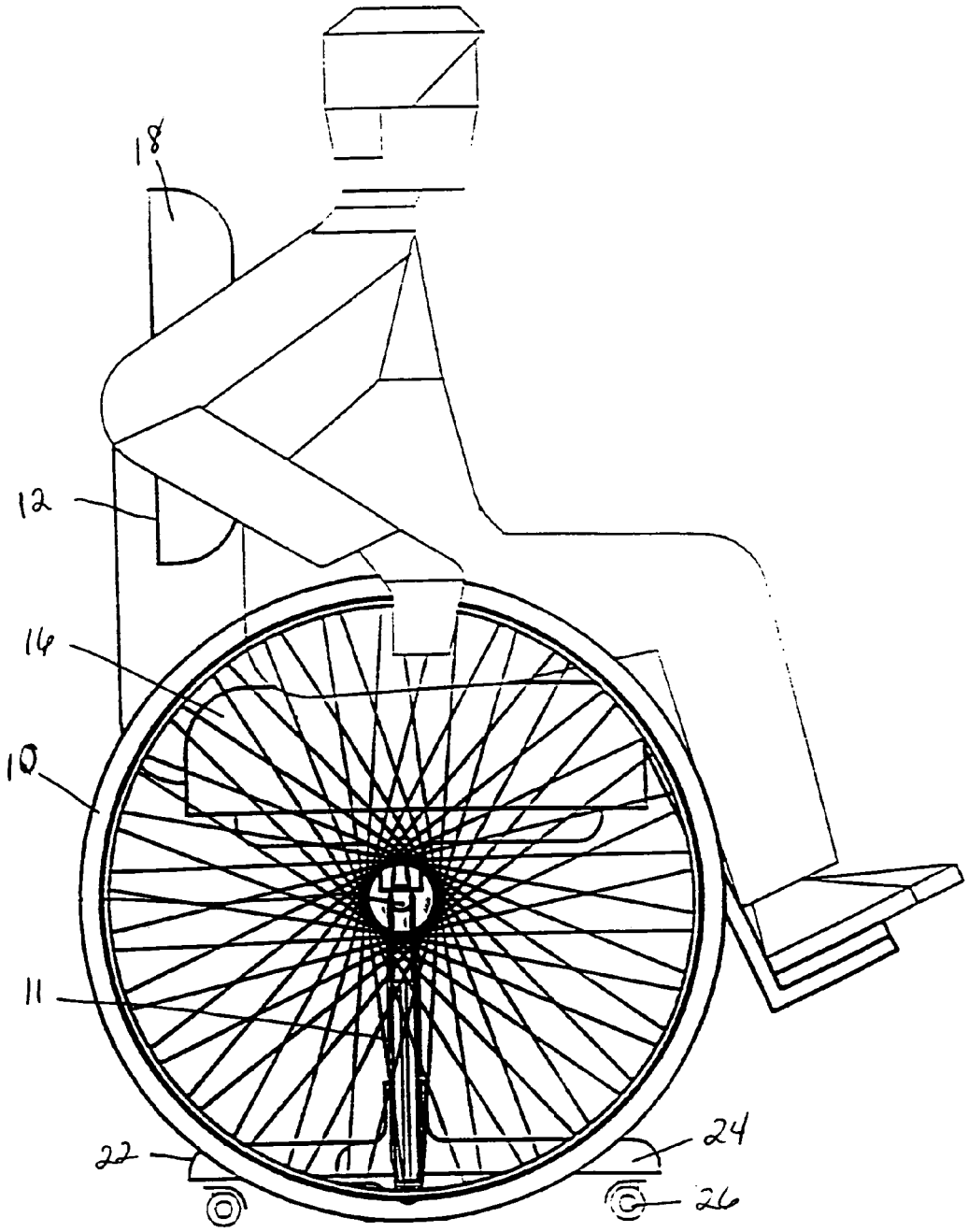
FIG. 7 shows a side view of another preferred embodiment of the wheeled work chair of the subject invention.

Another preferred embodiment of the wheeled work chair of the subject invention is shown in FIG. 7. The subject chair, unlike conventional wheelchairs, does not have a traditional chair four-point frame supporting four wheels.

Figure 8:
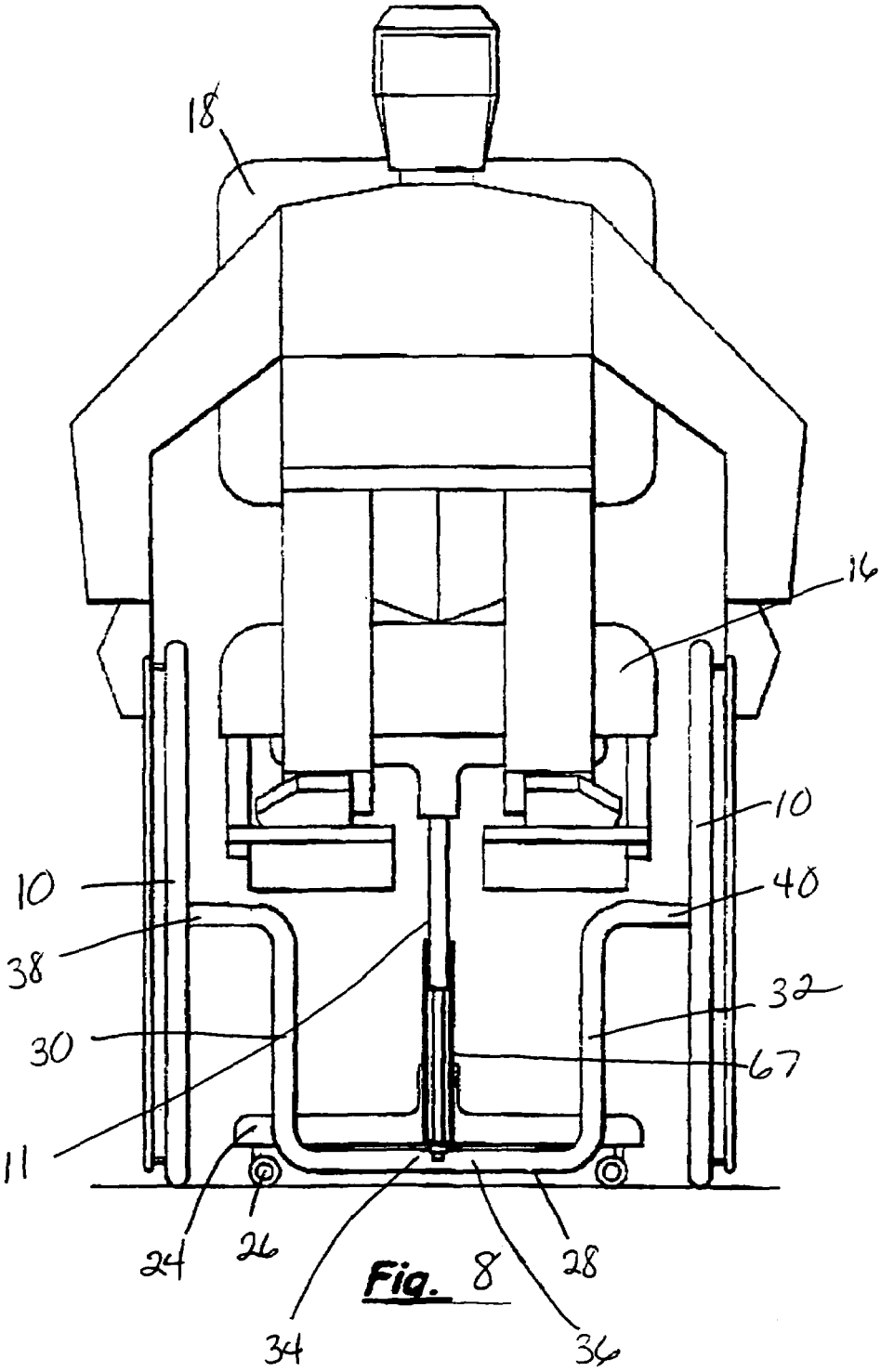
FIG. 8 shows a front view of another preferred embodiment of the wheeled work chair of the subject invention with the wheels connected to the lower portion of the chair.

FIG. 8 shows a front view of another preferred embodiment of the wheeled work chair of the subject invention. In this embodiment, the wheels 10 are connected to the lower portion 22 of the chair and do not rise when the upper portion 12 moves away from the lower portion.

Figure 9:
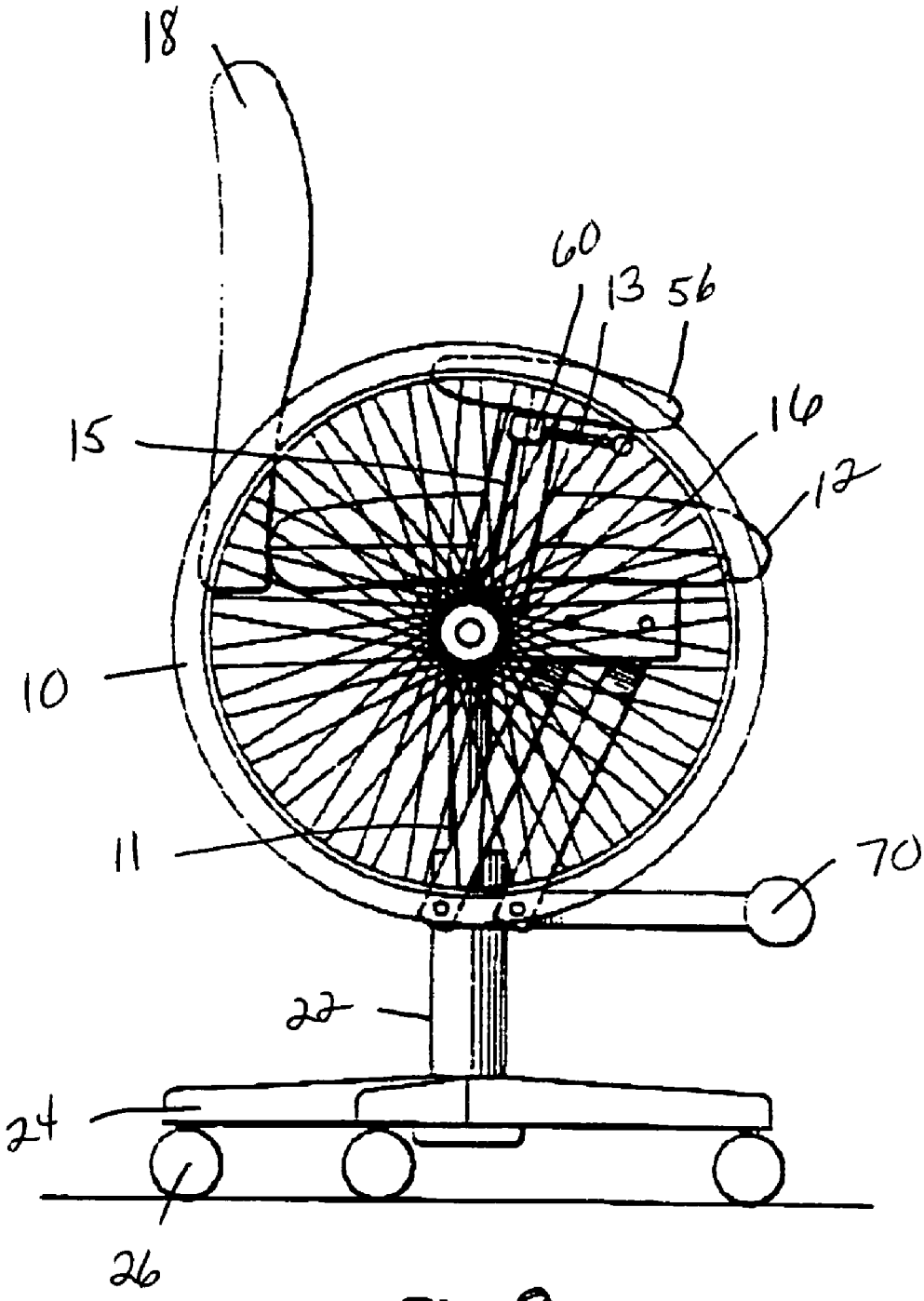
FIG. 9 shows a side view of another preferred embodiment of the wheeled work chair of the subject invention with the wheels connected to the upper portion of the chair.
Figure 10:
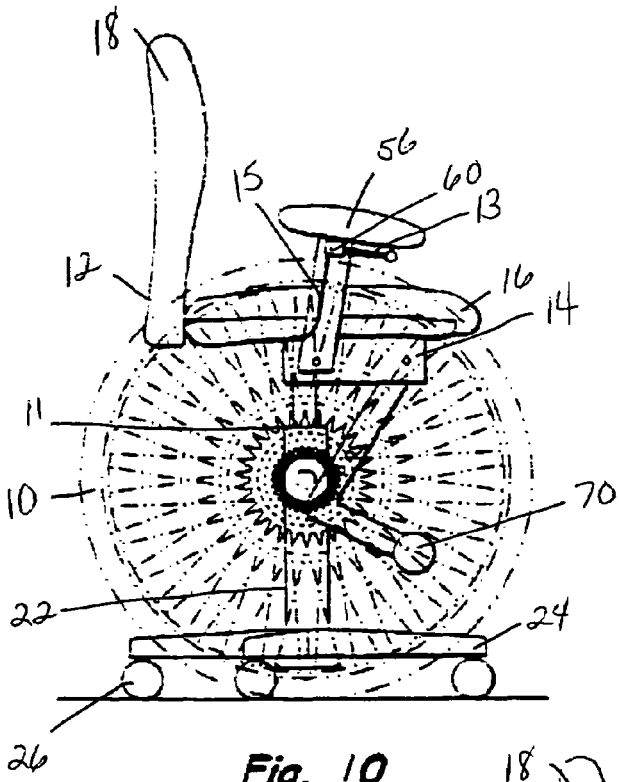
FIG. 10 shows a side view of another preferred embodiment of the wheeled work chair of the subject invention with the wheels connected to the lower portion of the chair.
Figure 11:
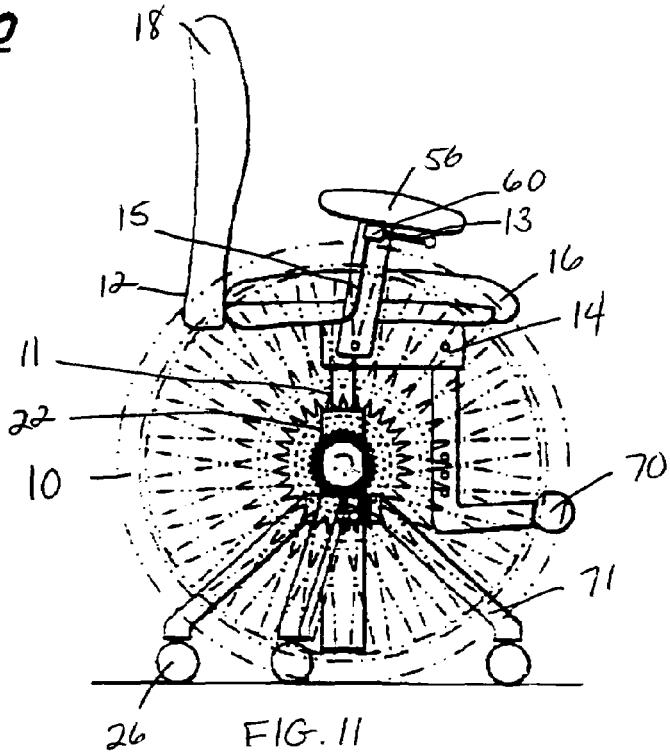
FIG. 11 shows another preferred embodiment of the wheeled work chair of the subject invention with the wheels connected to the lower portion of the chair which includes a base with upwardly extending legs.

FIG. 9 shows another preferred embodiment of the subject invention. The wheels 10 are attached to and rise with the upper portion 22. This embodiment includes a footrest 70 to support the feet of a person seated in the chair (U.S. Pat. No. 6,196,631). FIG. 10 shows a similar chair where the wheels 10 are attached to the lower portion 22 of the chair. FIG. 11 shows a chair with a footrest 70 and wheels attached to the lower portion 22 which has a base 24 with three upwardly extending legs 71.

Figure 12:
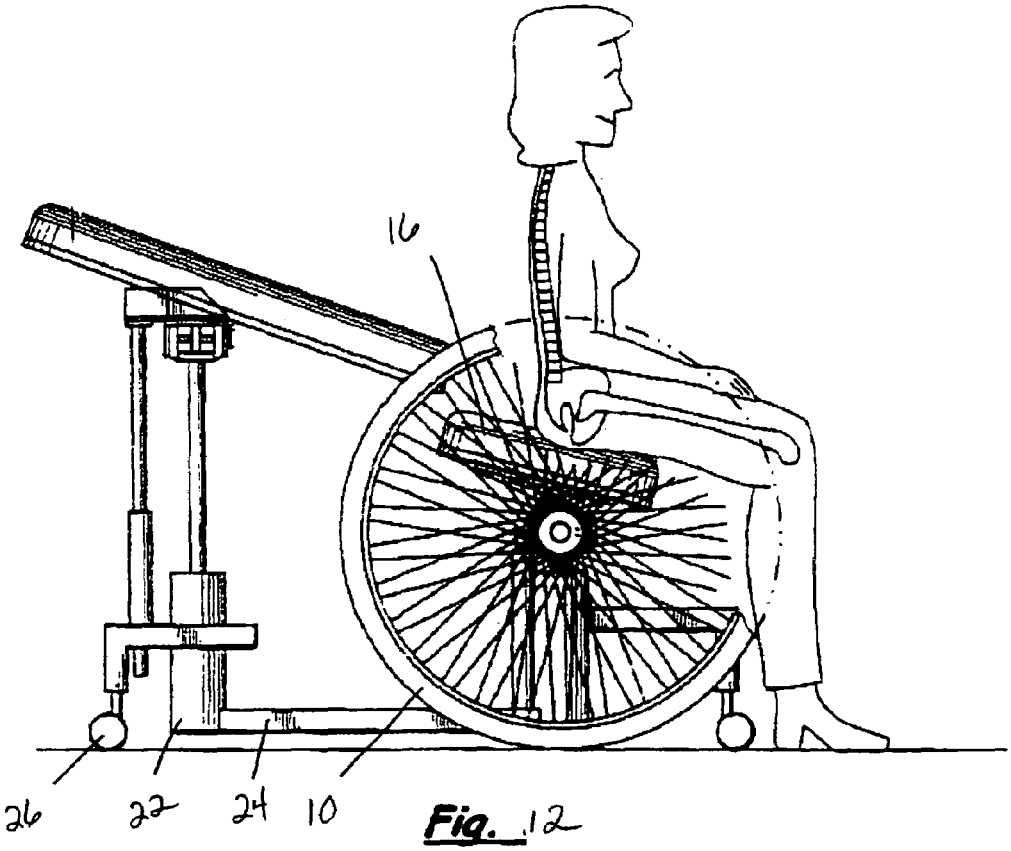
FIG. 12 shows a side view of another preferred embodiment of the wheeled work chair of the subject invention with the wheels connected to the upper portion of the chair.
Figure 13:
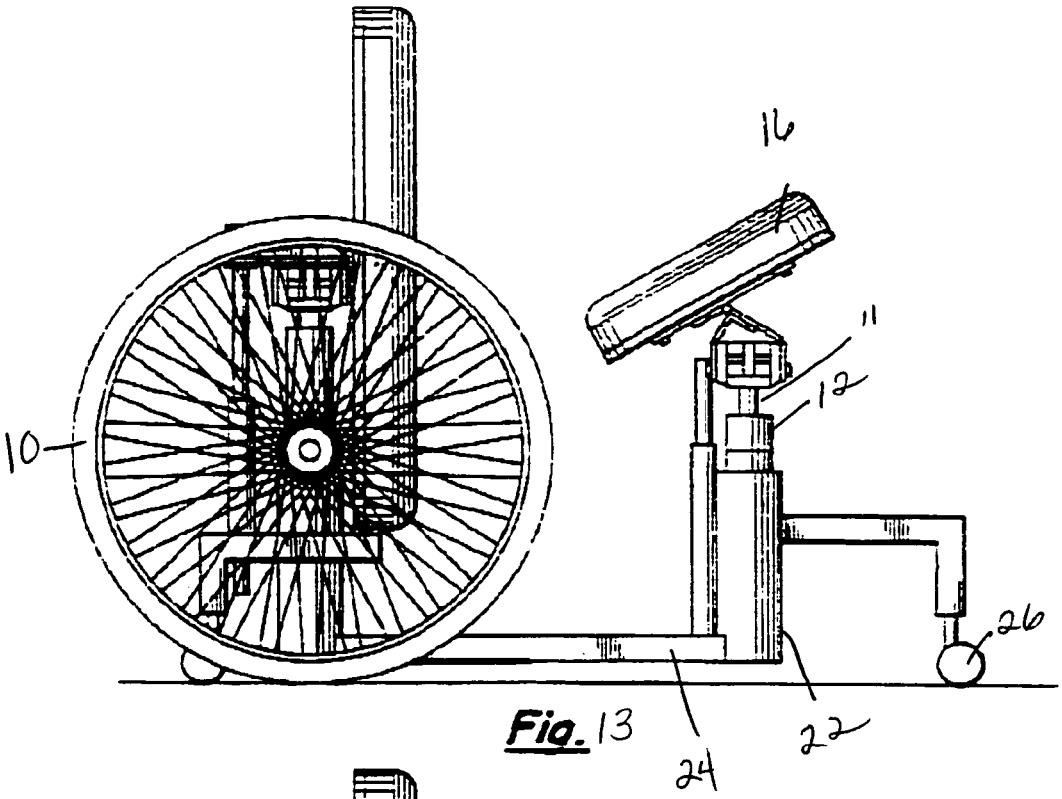
FIG. 13 shows a side view of the wheeled work chair shown in FIG. 12 with the wheels connected to the lower portion of the chair.

FIGS. 12-14 show another preferred embodiment of the chair of the subject invention. The chair (U.S. Pat. Nos. 5,186,519 and 5,330,254) has an upper portion 12 that moves relative to a lower portion 22. FIG. 12 shows the wheels 10 attached to the upper portion 12 of the chair which rises away from the lower portion 22 and base 24. FIGS. 13 and 14 show the wheels 10 attached to the lower portion 22 of the chair.

Figure 15:
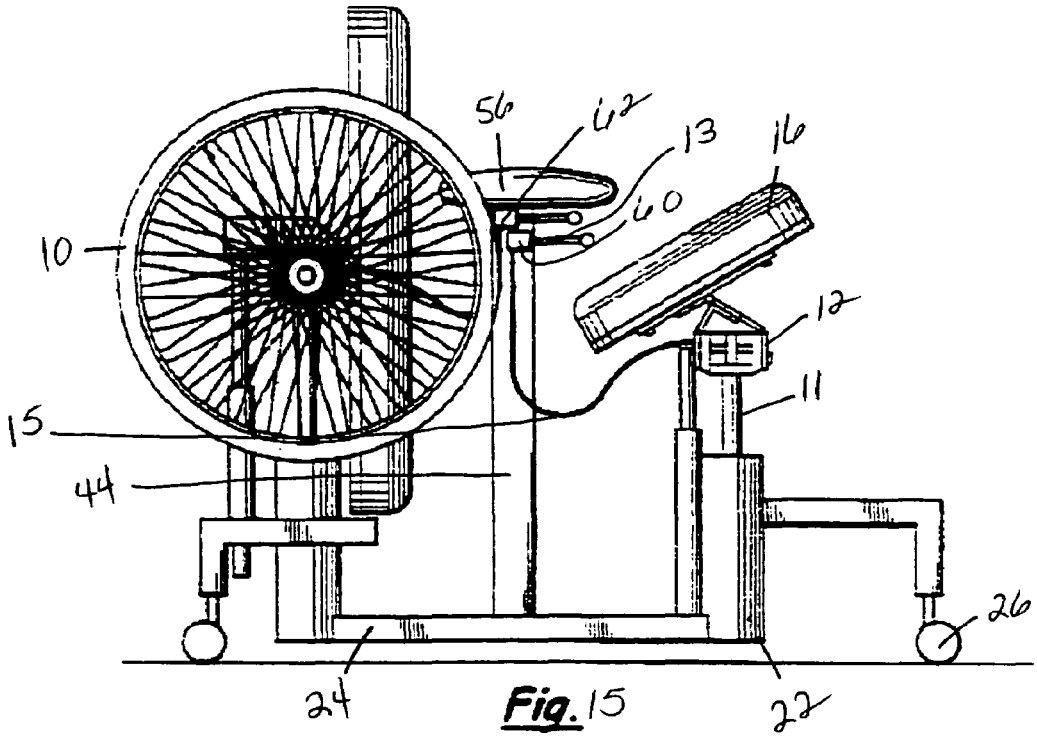
FIG. 15 shows a side view of another preferred embodiment of the wheeled work chair of the subject invention with the wheels connected to the upper portion.
Figure 16:
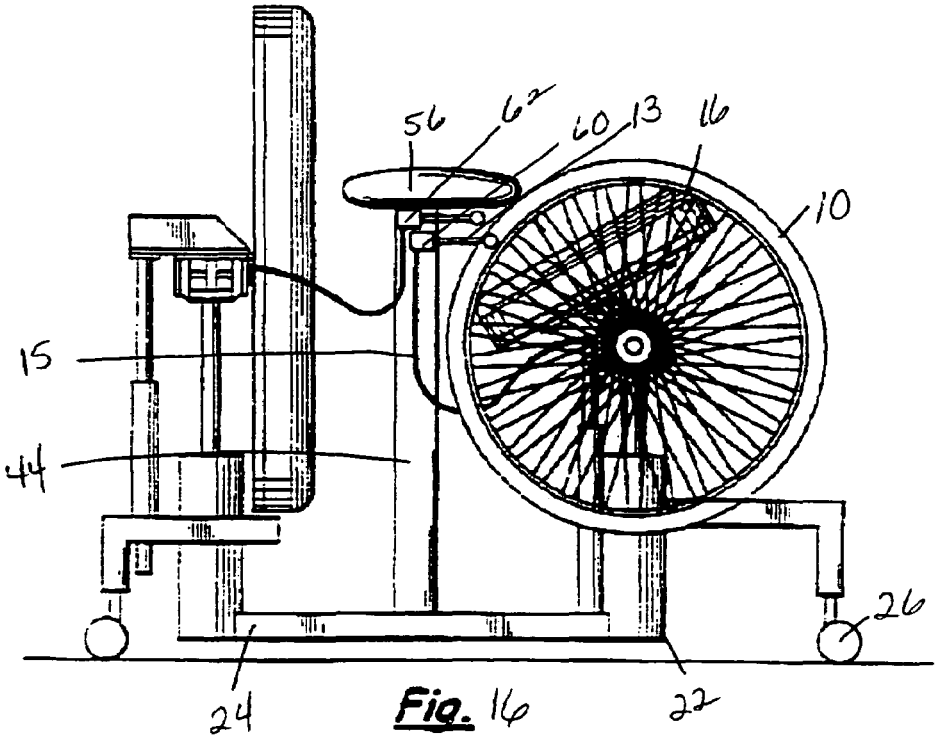
FIG. 16 shows a side view of the wheeled work chair shown in FIG. 15 with the wheels connected to the upper portion.
Figure 17:
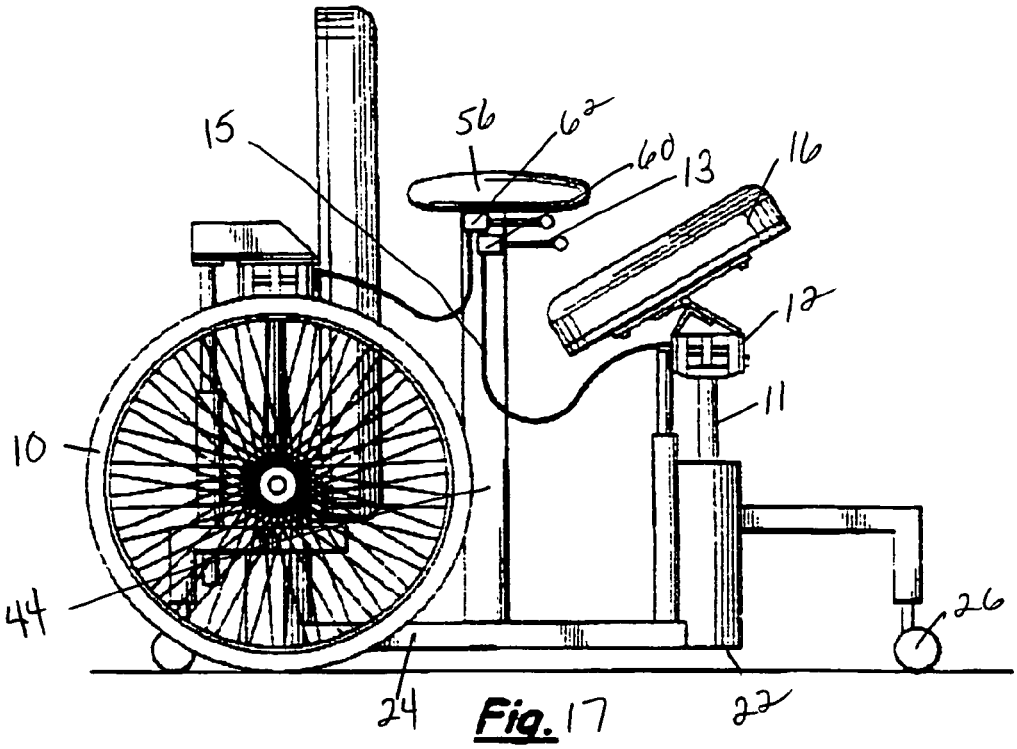
FIG. 17 shows a side view of the wheeled work chair shown in FIG. 15 with the wheels connected to the lower portion.
Figure 18:
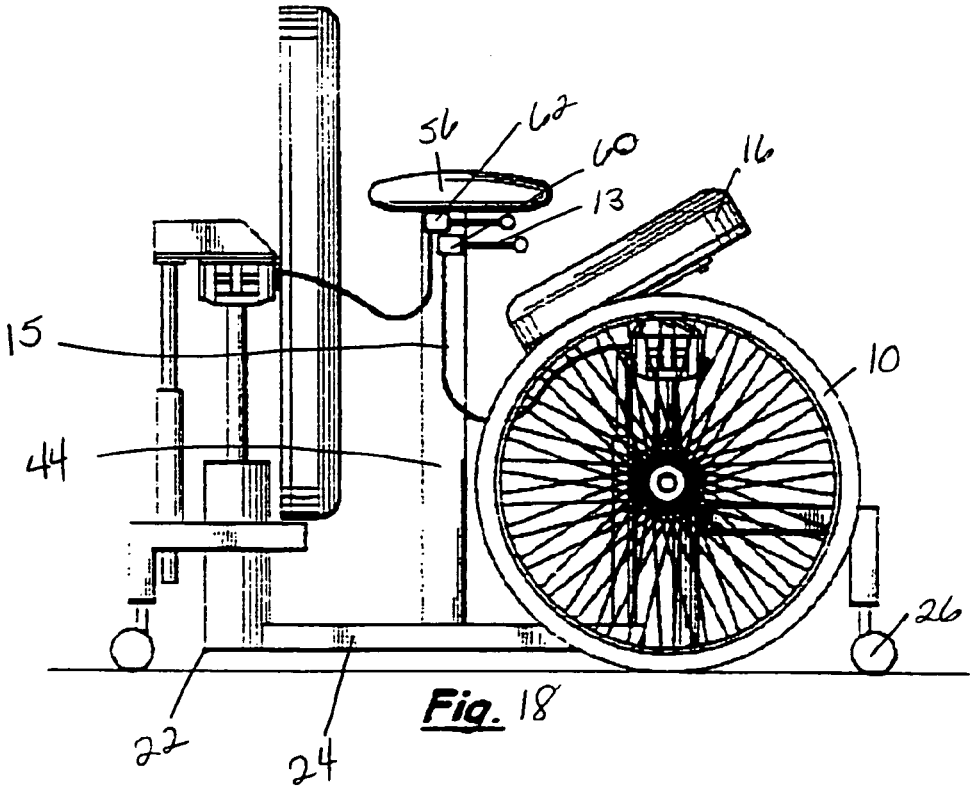
FIG. 18 shows a side view of the wheeled work chair shown in FIG. 15 with the wheels connected to the lower portion.

FIGS. 15-18 show another preferred embodiment of the height adjustable chair of the subject invention. The chair has push-off arm rests 56, 58, not shown, supported by push-off arm rest support 44, 46, not shown. A remote actuation mechanism 60 controls motion of the upper portion. FIGS. 15 and 16 show the wheels 10 connected to the upper portion 12 of the chair. FIGS. 17 and 18 show the wheels 10 connected to the lower portion of the chair.

Figure 19:
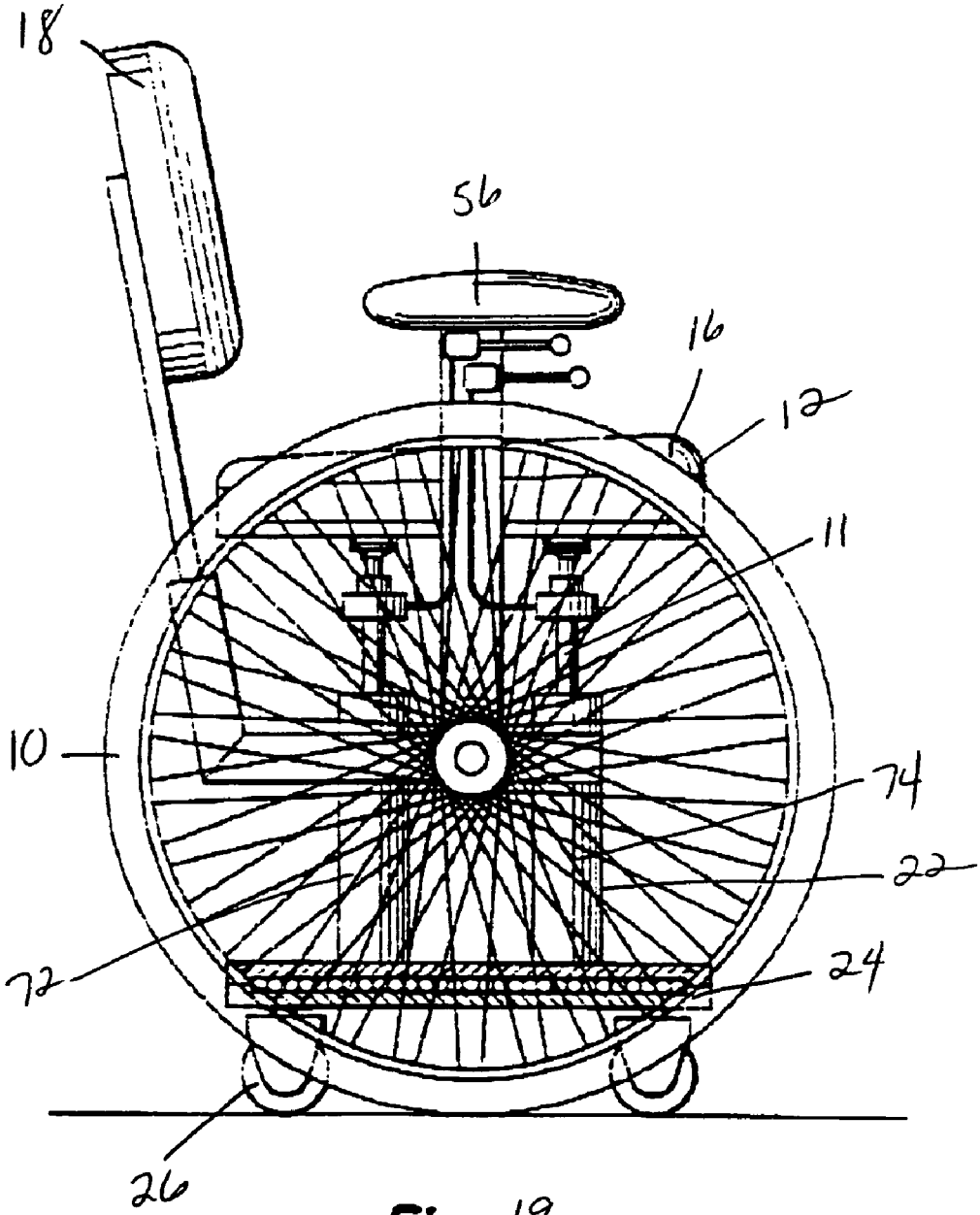
FIG. 19 shows a side view of another preferred embodiment of the wheeled work chair of the subject invention with the wheels connected to the lower portion.

FIG. 19 shows another preferred embodiment of the wheeled work chair of the subject invention. This embodiment has two telescoping support mechanisms 72, 74. The wheels 10 are attached to the lower portion 22 of the chair.

Figure 20:
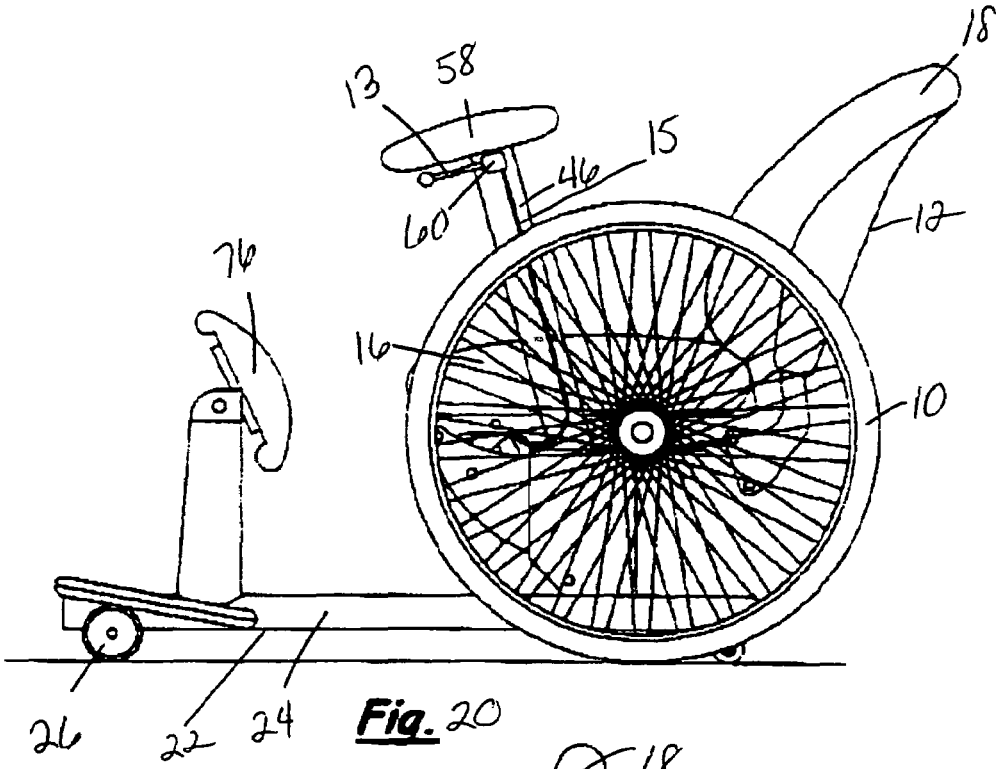
FIG. 20 shows a side view of another preferred embodiment of the wheeled work chair of the subject invention with the wheels connected to the upper portion.
Figure 21:
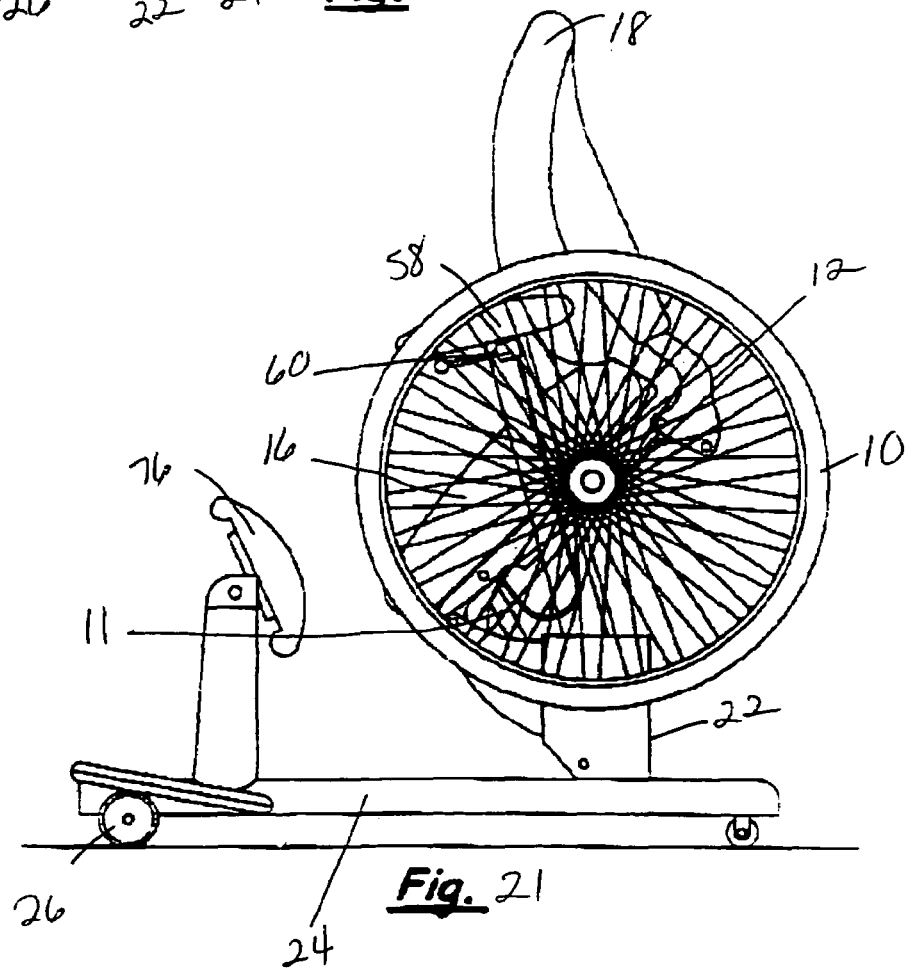
FIG. 21 shows a side view of the wheeled work chair shown in FIG. 20 with the seat position adjusted upward.
Figure 22:
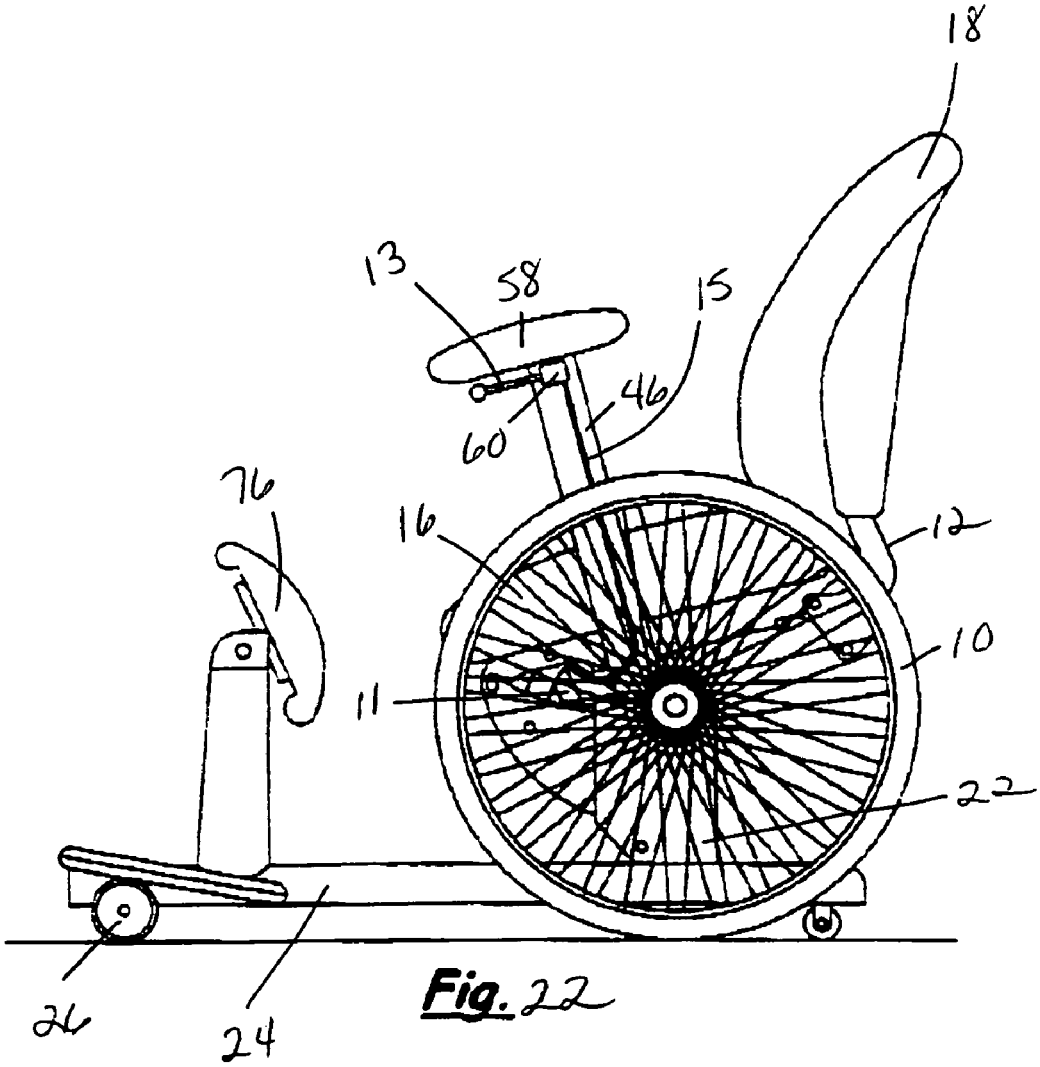
FIG. 22 shows a side view of another embodiment of the wheeled work chair shown in FIG. 20 with the wheels connected to the lower portion.
Figure 23:
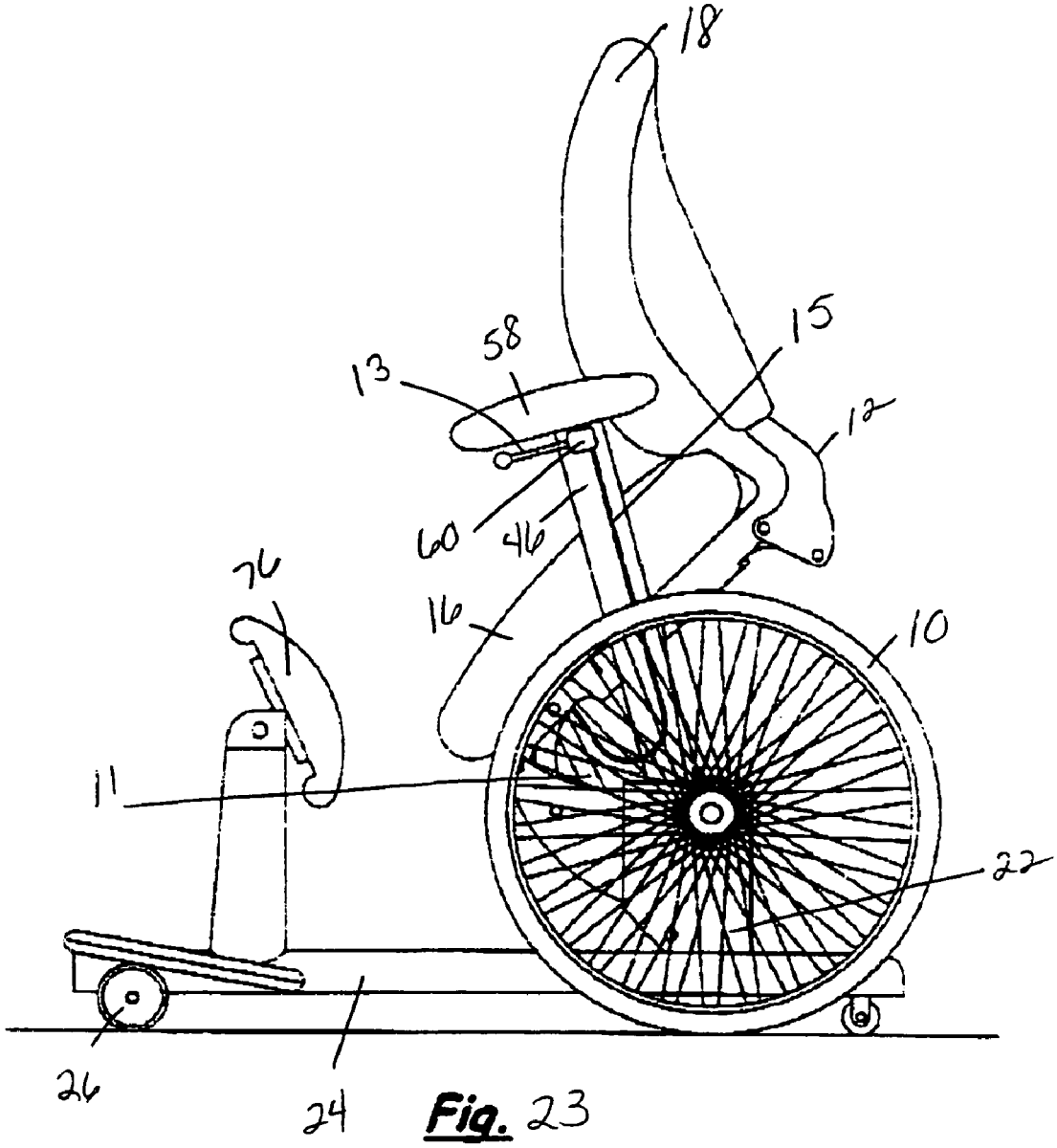
FIG. 23 shows a side view of the wheeled work chair shown in FIG. 22 with the seat position adjusted upward.

FIGS. 20-23 show another preferred embodiment of the wheeled work chair of the subject invention. The chair (U.S. Pat. Nos. 6,439,657 and 6,702,372) includes an upper portion 12 that moves relative to a lower portion 22. The upper portion includes a seat support mechanism 14, a chair seat 16 and a seat back 18. The lower portion includes a base 24 on castors 26 and a pivoting knee pad 76. The push-off arm rests have a remote actuator 60 and are secured to the lower portion 22. FIGS. 20 and 21 show the wheels connected to the upper portion of the chair. FIG. 21 shows the chair when the seat position has been moved. FIGS. 22 and 23 show the wheels connected to the lower portion of the chair. FIG. 23 shows the chair when the seat position has been moved.

Figure 24:
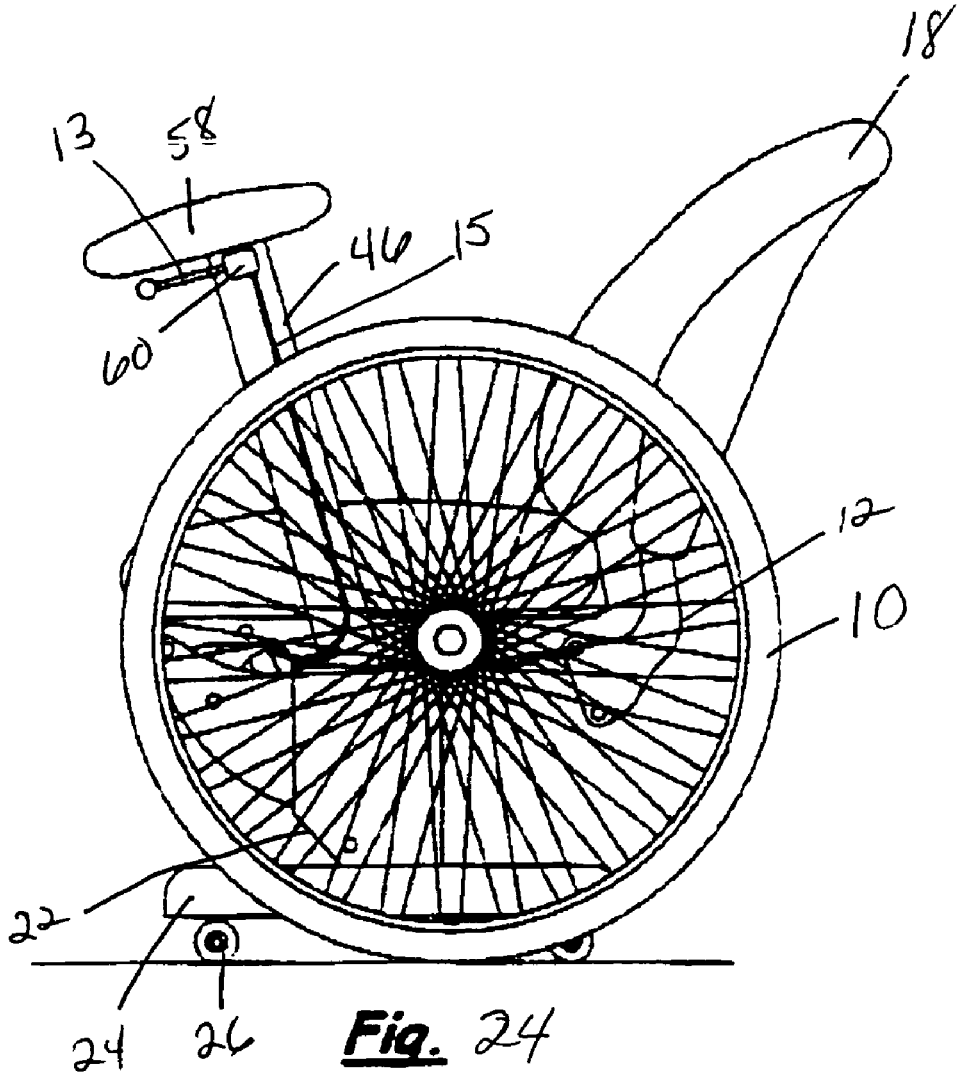
FIG. 24 shows another preferred embodiment of the wheeled work chair of the subject invention.
Figure 25:
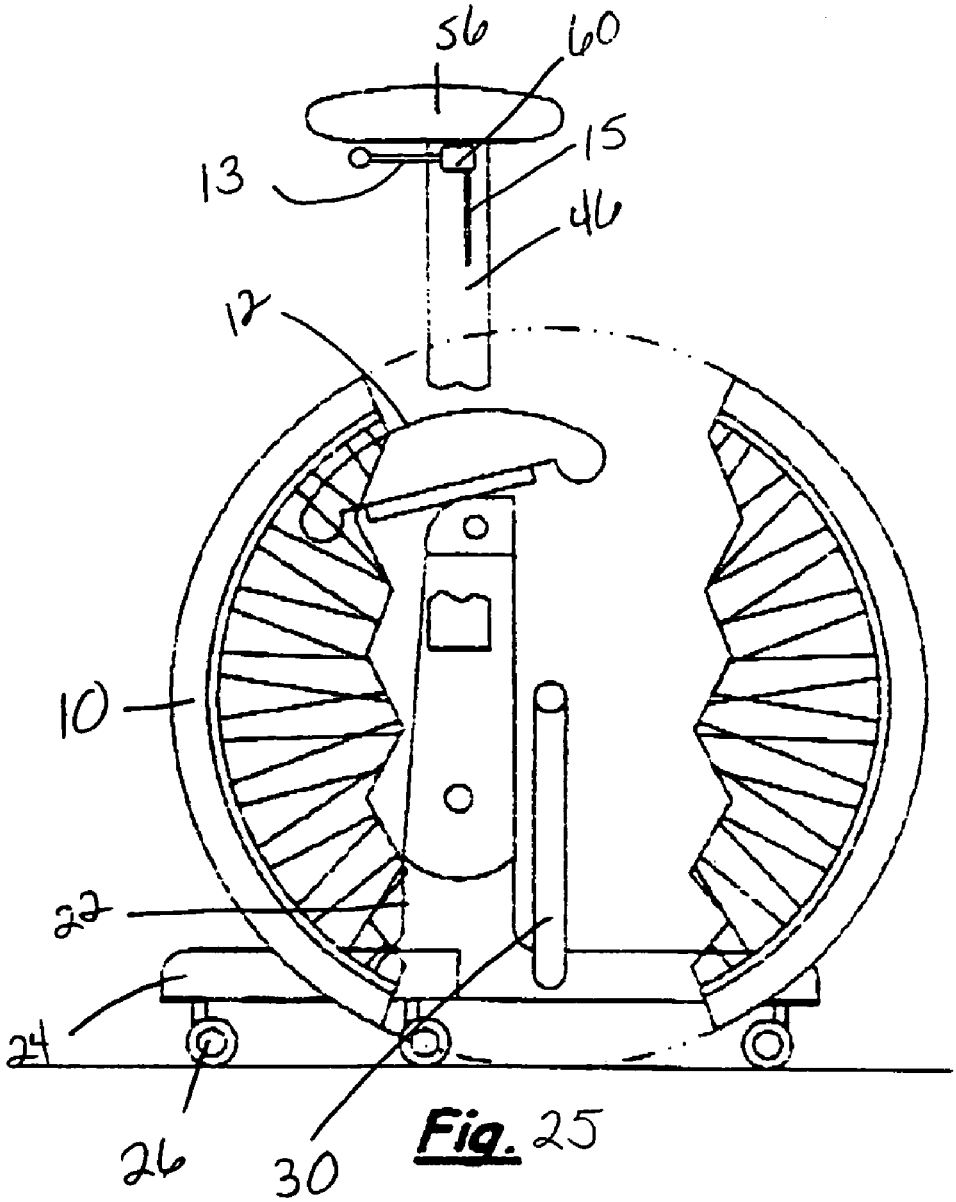
FIG. 25 shows another preferred embodiment of the wheeled work chair of the subject invention.

FIG. 24 shows another preferred embodiment of the wheeled work chair of the subject invention where the wheels are connected to the upper portion of the chair. FIG. 25 shows another preferred embodiment where the wheels are supported directly by the lower portion 22 with wheel support members 30, 32, not shown. The push-off arm rests 56, 58, not shown, are likewise supported directly by the lower portion and do not pivot.

It is understood that the foregoing examples are merely illustrative of the present invention. Certain modifications of the devices and/or methods employed may be made and still achieve the objectives of the invention. Such modifications are contemplated as within the scope of the claimed invention.

The invention claimed is:

1. A wheeled work chair comprising:

a base comprising at least three floor contacting castors; wherein each castor swivels, and can contact and roll along a floor surface;

a seat support mechanism positionally supported above said base;

a chair seat supported above said seat support mechanism and positioned by said seat support mechanism;

an height adjustment mechanism disposed between said base and said chair seat, wherein said height adjustment mechanism is supported by said base; wherein said chair seat and said seat support mechanism are supportedly positioned by said height adjustment mechanism; wherein said height adjustment mechanism can move; wherein movement of said height adjustment mechanism can result in changing the position of said chair seat relative to said base;

wherein said seat support mechanism is supported by said height adjustment mechanism, and secures said chair seat to said height adjustment mechanism;

a wheel supporting mechanism secured to said wheeled work chair comprising first and second wheel support members, each wheel support member extending in opposite directions from each other; wherein each wheel support member comprises a first end; and a second end; wherein said first ends are secured to said wheeled work chair;

a first wheel secured to said second end of said first wheel support member; and a second wheel secured to said second end of said second wheel support member; wherein each wheel can rotate in a substantially vertical plane; wherein said second ends of each wheel support member comprises a common axis upon which each wheel rotates substantially parallel to each other; wherein said first and second wheels cannot swivel in relationship to each other; and wherein each wheel comprises an outer diameter which can contact and roll along a floor surface;

wherein said first and second wheels are positioned on said wheeled work chair convenient for a seated person to use his or her hands to move himself or herself about over a floor surface without use of his or her feet;

wherein said wheeled work chair comprises an upper portion and a lower portion; wherein the position of said upper portion can be changed relative to said lower portion; wherein said lower portion comprises at least said base; wherein said upper portion comprises at least said seat support mechanism and said chair seat.

2. The wheeled work chair of claim 1, comprising a push-off arm rest supporting mechanism supported by said base; wherein said push-off arm rest supporting mechanism comprises first and second push-off arm rest supports extending upwardly from said push-off arm rest supporting mechanism, wherein each push-off arm rest support includes a first end, and a second end; wherein said first end of each push-off arm rest support is supported by said lower portion;

first and second push-off arm rests disposed on respective second ends of said first and said second push-off arm rest supports; wherein a seated wheeled work chair user can grip said push-off arm rests with user's hands and push down thereon to reduce user's body weight from said chair seat and correspondingly reduce force to said height adjustment mechanism;

wherein the position of said chair seat can be moved to change the body position of a person while said person's full body weight is supported on said wheeled work chair, at least upwardly relative to the floor.

3. The wheeled work chair of claim 2, comprising means to lock and unlock said upper and lower portions of said wheeled work chair; wherein when locked, relative change in elevation between said upper portion and said lower portion can be prevented, and when unlocked, relative change in elevation between said upper portion and said lower portion can be allowed; wherein said means comprises a remote actuation mechanism;

wherein said remote actuation mechanism is supported on said push-off arm rest supporting mechanism and is so disposed that a person sitting on said chair seat can reach and move said remote actuation mechanism while keeping both hands on said push-off arm rest supporting mechanism.

4. The wheeled work chair of claim 2, wherein said spring comprises a movable resilient spring material; wherein when said upper portion of said wheeled work chair is moved toward said lower portion with sufficient force, said resilient spring material can be resiliently moved, wherein absent sufficient force, said resilient spring material can resiliently move resulting in moving said second portion away from said first portion, resulting in moving said seat support mechanism and correspondingly moving said chair seat away from said base.

5. The wheeled work chair of claim 1, wherein said height adjustment mechanism comprises a spring disposed between said base and said seat support mechanism.

6. The wheeled work chair of claim 5, wherein said spring comprises a non-locking gas spring comprising first and second telescoping sections; wherein said first section comprises a cylinder, and said second section comprises a piston rod disposed within said cylinder and extending outwardly therefrom; wherein said non-locking gas spring is disposed above said base and is supported by said base; wherein one of said first and second sections is secured to said seat support mechanism; wherein said movable spring material comprises pressurized gas disposed within said cylinder; and a fluid flow control valve disposed within said cylinder.

7. The wheeled work chair of claim 2, wherein said spring comprises a locking gas spring comprising a movable fluid flow control valve stem extending outwardly from said locking gas spring; and an actuation button comprising the outwardly extending end of said movable fluid flow control valve stem; wherein said actuation button can be moved from a first locked position to a second unlocked position; wherein said unlocked position allows relative longitudinal movement between said cylinder and said piston rod, wherein said locking gas spring is actuated.

8. The wheeled work chair of claim 7, wherein said wheeled work chair comprises an actuation mechanism for moving said actuation button from said first locked position to said second unlocked position resulting in actuating said locking gas spring.

9. The wheeled work chair of claim 7, wherein said wheeled work chair comprises a remote actuation mechanism for moving said actuation button; wherein said remote actuation mechanism comprises first and second ends; wherein said first end is disposed proximate said actuation button for movable engagement with said actuation button, and wherein said second end extends to a position proximate said push-off arm rest supporting mechanism; wherein said second end is supported by said push-off arm rest supporting mechanism and is so disposed that a person sitting on said chair seat can reach and move said remote actuation mechanism while keeping both hands on said push-off arm rest supporting mechanism.

10. The wheeled work chair of claim 1, wherein said height adjustment mechanism comprises at least one telescoping support mechanism which can contract and extend; wherein each telescoping support mechanism comprises a lower section supported by said base; and an upper section disposed in parallel alignment at least in part to each respective lower section; wherein each upper section of each telescoping support mechanism can move, toward and away from, each respective lower section; wherein said seat support mechanism secures said upper section of each telescoping support mechanism to said chair seat.

11. The wheeled work chair of claim 3, wherein said height adjustment mechanism comprises a height adjustment column extending longitudinally between said base and said chair seat, wherein said height adjustment column comprises an upper section and a lower section; wherein said lower section is supported by said base and comprises said lower portion; wherein said upper section comprises said upper portion and can move upwardly and downwardly relative to said lower section; wherein said seat support mechanism secures said chair seat to said upper section of said height adjustment column.

12. The wheeled work chair of claim 11, comprising a lockable height adjustment column comprising means to lock and unlock said height adjustment column; wherein said means comprises a movable actuation button; wherein said movable actuation button can be selectively moved from a locked position where said upper and lower sections of said height adjustment column cannot move relative to each other, to an unlocked position where said upper and lower sections of said height adjustable column can move relative to each other, wherein said height adjustment column can be actuated.

13. The wheeled work chair of claim 11, wherein said height adjustment column comprises at least one telescoping support mechanism which can contract and extend; wherein each telescoping support mechanism comprises a lower section supported by said base; and an upper section disposed in parallel alignment at least in part to each respective lower section; wherein each upper section of each telescoping support mechanism can move longitudinally in parallel alignment at least in part, toward and away from, each respective lower section; wherein said seat support mechanism secures said upper section of each telescoping support mechanism to said chair seat; wherein each upper section of each telescoping support mechanism comprises said upper portion of said wheeled work chair; and wherein each lower section of each telescoping support mechanism comprises said lower portion of said wheeled work chair.

14. "The wheeled work chair of claim 13, comprising at least one stand tube disposed above said base and supported by said base and comprising said lower portion; wherein at least one telescoping support mechanism is supported by said at least one stand tube; wherein said upper portion of at least one of said telescoping support mechanism extends between said at least one stand tube and said seat support mechanism."

15. The wheeled work chair of claim 13, wherein said height adjustment column comprises at least two telescoping support mechanisms which can contract and extend; wherein said seat support mechanism cannot rotate relative to said base.

16. The wheeled work chair of claim 1, wherein said push-off arm rest supporting mechanism is secured to said lower portion.

17. The wheeled work chair of claim 2, wherein said push-off arm rest supporting mechanism can be rotably secured to said lower portion.

18. The wheeled work chair of claim 2, including means for locking said push-off arm rest supporting mechanism; wherein said push-off arm rest supporting mechanism can be locked against rotation relative to said lower portion.

19. The wheeled work chair of claim 2, wherein said first and second push-off arm rest supports are each detachable from said wheeled work chair.

20. The wheeled work chair of claim 16, wherein said push-off arm rest supporting mechanism is detachable from said wheeled work chair.

21. The wheeled work chair of claim 1, comprising means to lock and unlock said upper and lower portions of said wheeled work chair; wherein when locked, relative change in elevation of said upper portion relative to said lower portion can be prevented, and when unlocked, relative change in elevation of said upper portion relative to said lower portion can be allowed; wherein said means comprises an actuation mechanism.

22. "The wheeled work chair of claim 2, wherein said first and said second push-off arm rest supports each comprise upper and lower telescoping sections; and a locking means; wherein said upper sections can be adjusted upwardly and downwardly relative to said respective first sections; and wherein said upper and lower sections of each push-off arm rest support can be locked against said relative movement.

23. The wheeled work chair of claim 2, wherein said seat support mechanism comprises means for slidably securing said seat support mechanism to said first and second push-off arm rest supports thereby allowing aligned upward and downward movement of said seat support mechanism relative to said push-off arm rest supports; wherein said seat support mechanism is prevented from rotating relative to said push-off arm rest supports.

24. The wheeled work chair of claim 2, wherein said chair seat can be slidably secured to said first and said second push-off arm rest supports thereby allowing aligned upward and downward movement of said chair seat relative to said push-off arm rest supports; wherein said chair seat is prevented from rotating relative to said push-off arm rest supports.

25. The wheeled work chair of claim 1, wherein said upper portion can rotate relative to said lower portion.

26. The wheeled work chair of claim 25, including anti-rotation means for preventing said upper portion from rotating relative to said lower portion.

27. The wheeled work chair of claim 1, comprising at least one arm rest support; wherein said arm rest support includes a lower end supported by said upper portion; and an upper end disposed above said chair seat; wherein said upper end comprises an arm rest disposed above said chair seat.

28. The wheeled work chair of claim 27, wherein at least one arm rest support comprises a remote actuation mechanism comprising means to lock and unlock said upper and lower portions of said wheeled work chair; wherein when locked, relative change in elevation of said upper portion relative to said lower portion can be prevented, and when unlocked, relative change in elevation of said upper portion relative to said lower portion can be allowed.

29. The wheeled work chair of claim 27, wherein said arm rest support comprises a remote actuation mechanism for actuating said height adjustment mechanism.

30. The wheeled work chair of claim 2, wherein said wheel supporting mechanism is secured to said lower portion.

31. The wheeled work chair of claim 1, wherein said first and said second wheel support members are secured to said upper portion.

32. The wheeled work chair of claim 31, wherein said second ends of each of said first and second wheel support members are slidably secured to respective first and second push-off arm rest supports thereby allowing aligned upward and downward movement of said first and second wheels relative to said first and second push-off arm rest supports.

33. The wheeled work chair of claim 1, wherein said wheel supporting mechanism is detachable from said wheeled work chair.

34. The wheeled work chair of claim 1, wherein said first and said second wheel support members and detachable from said wheeled work chair.

35. The wheeled work chair of claim 1, wherein said first and said second wheels are detachable from said wheeled work chair.

36. The wheeled work chair of claim 1, wherein each of said first and said second wheels comprise a hand rim of lesser diameter than said outer surface of said first and said second wheels.

37. The wheeled work chair of claim 1, wherein said base comprises at least three upwardly extending legs; wherein each leg comprise a lower end; wherein said lower end of each leg comprises a castor that can swivel and roll along a floor surface.

38. The wheeled work chair of claim 1, comprising a footrest secured to said wheeled work chair.

39. The wheeled work chair of claim 38, wherein said chair seat comprises a perimeter edge comprising at least a front edge and two side edges; wherein said footrest comprises chair attachment means for attachment to said wheeled work chair; wherein said chair attachment means is disposed within said perimeter edge of said chair seat; a footrest actuating mechanism supported by said chair attachment means for rotational movement in relation to said chair attachment means; and a footrest brace; and at least one footrest brace support arm disposed between said footrest brace and said footrest actuating mechanism; a first pivot on said chair attachment means; wherein said firs pivot is disposed in a substantially horizontal orientation; wherein said at least one footrest brace support arm is pivotally attached to said chair attachment means at the first pivot for movement in a substantially vertical plane; and wherein said at least one footrest brace support arm movably suspends said footrest brace in relation to said chair attachment means; and, wherein said footrest brace comprises a foot contact surface; and, wherein said footrest actuating mechanism engages said at least one footrest brace support arm, wherein movement of said footrest actuating mechanism can cause at least one footrest brace support arm to move; wherein said footrest brace may be centered in relation to said front edge of said chair seat; and wherein said footrest brace when centered in relation to said front edge of said chair seat is selectively movable through at least a range of movement from a position where the entirety of each footrest brace support arm as well as said footrest brace are disposed beneath said front edge of said chair seat, within the perimeter edge of said chair seat; to a position where the footrest brace is in front of the front edge of the chair seat; and wherein said foot contact surface of said footrest brace is disposed at the spaced apart distance from the chair seat for direct support of a wheeled chair user's feet in an elevated position in relation to said floor surface on which said chair base is supported; wherein rotational movement of said footrest actuating mechanism can cause said footrest brace to move in relation to said chair attachment means.

40. A wheeled work chair comprising:

a base comprising one castor; wherein said castor swivels, and can contact and roll along a floor surface;

a seat support mechanism positionally supported above said base;

a chair seat supported above said seat support mechanism and positioned by said seat support mechanism;

an height adjustment mechanism disposed between said base and said chair seat, wherein said height adjustment mechanism is supported by said base; wherein said chair seat and said seat support mechanism are supportedly positioned by said height adjustment mechanism; wherein said height adjustment mechanism can move; wherein movement of said height adjustment mechanism can result in changing the position of said chair seat relative to said base;

wherein said seat support mechanism is supported by said height adjustment mechanism, and secures said chair seat to said height adjustment mechanism;

wherein said wheeled work chair comprises an upper portion and a lower portion; wherein the position of said upper portion can be changed relative to said lower portion; wherein said lower portion comprises at least said base; wherein said upper portion comprises at least said seat support mechanism and said chair seat;

a wheel supporting mechanism secured to said lower portion comprising first and second wheel support members, each wheel support member extending in opposite directions from each other; wherein each wheel support member comprises a first end; and a second end; wherein said first ends are secured to said wheeled work chair;

a first wheel secured to said second end of said first wheel support member; and a second wheel secured to said second end of said second wheel support member; wherein each wheel can rotate in a substantially vertical plane; wherein said second ends of each wheel support member comprises a common axis upon which each wheel rotates substantially parallel to each other; wherein said first and second wheels cannot swivel in relationship to each other; and wherein each wheel comprises an outer diameter which can contact and roll along a floor surface;

wherein said first and second wheels are positioned on said wheeled work chair convenient for a seated person to use his or her hands to move himself or herself about over a floor surface without use of his or her feet;

a push-off arm rest supporting mechanism supported by said base; wherein said push-off arm rest supporting mechanism comprises first and second push-off arm rest supports extending upwardly from said push-off arm rest supporting mechanism, wherein each push-off arm rest support includes a first end, and a second end; wherein said first end of each push-off arm rest support is supported by said lower portion;

first and second push-off arm rests disposed on respective second ends of said first and said second push-off arm rest supports; wherein a seated wheeled work chair user can grip said push-off arm rests with user's hands and push down thereon to reduce user's body weight from said chair seat and correspondingly reduce force to said height adjustment mechanism;

wherein the position of said chair seat can be moved to change the body position of a person while said person's full body weight is supported on said wheeled work chair, at least upwardly relative to the floor.

41. The wheeled work chair of claim 40, wherein said height adjustment mechanism comprises a spring disposed between said base and said seat support mechanism.

42. The wheeled work chair of claim 41, wherein said spring comprises a non-locking gas spring comprising first and second telescoping sections; wherein said first section comprises a cylinder, and said second section comprises a piston rod disposed within said cylinder and extending outwardly therefrom; wherein said non-locking gas spring is disposed above said base and is supported by said base; wherein one of said first and second sections is secured to said seat support mechanism; wherein said movable spring material comprises pressurized gas disposed within said cylinder; and a fluid flow control valve disposed within said cylinder.

43. The wheeled work chair of claim 42, wherein said spring comprises a locking gas spring comprising a movable fluid flow control valve stem extending outwardly from said locking gas spring; and an actuation button comprising the outwardly extending end of said movable fluid flow control valve stem; wherein said actuation button can be moved from a first locked position to a second unlocked position; wherein said unlocked position allows relative longitudinal movement between said cylinder and said piston rod, wherein said locking gas spring is actuated.

44. The wheeled work chair of claim 43, wherein said wheeled work chair comprises an actuation mechanism for moving said actuation button from said first locked position to said second unlocked position resulting in actuating said locking gas spring.

45. The wheeled work chair of claim 43, wherein said wheeled work chair comprises a remote actuation mechanism for moving said actuation button; wherein said remote actuation mechanism comprises first and second ends; wherein said first end is disposed proximate said actuation button for movable engagement with said actuation button, and wherein said second end extends to a position proximate said push-off arm rest supporting mechanism; wherein said second end is supported by said push-off arm rest supporting mechanism and is so disposed that a person sitting on said chair seat can reach and move said remote actuation mechanism while keeping both hands on said push-off arm rest supporting mechanism.

46. The wheeled work chair of claim 40, wherein said height adjustment mechanism comprises at least one telescoping support mechanism which can contract and extend; wherein each telescoping support mechanism comprises a lower section supported by said base; and an upper section disposed in parallel alignment at least in part to each respective lower section; wherein each upper section of each telescoping support mechanism can move, toward and away from, each respective lower section; wherein said seat support mechanism secures said upper section of each telescoping support mechanism to said chair seat.

47. The wheeled work chair of claim 40, wherein said height adjustment mechanism comprises a height adjustment column extending longitudinally between said base and said chair seat, wherein said height adjustment column comprises an upper section and a lower section; wherein said lower section is supported by said base and comprises said lower portion; wherein said upper section comprises said upper portion and can move upwardly and downwardly relative to said lower section; wherein said seat support mechanism secures said chair seat to said upper section of said height adjustment column.

48. The wheeled work chair of claim 47, wherein said height adjustment column comprises at least one telescoping support mechanism which can contract and extend; wherein each telescoping support mechanism comprises a lower section supported by said base; and an upper section disposed in parallel alignment at least in part to each respective lower section; wherein each upper section of each telescoping support mechanism can move longitudinally in parallel alignment at least in part, toward and away from, each respective lower section; wherein said seat support mechanism secures said upper section of each telescoping support mechanism to said chair seat; wherein each upper section of each telescoping support mechanism comprises said upper portion of said wheeled work chair; and wherein each lower section of each telescoping support mechanism comprises said lower portion of said wheeled work chair.

49. The wheeled work chair of claim 47, comprising a lockable height adjustment column comprising means to lock and unlock said height adjustment column; wherein said means comprises a movable actuation button; wherein said movable actuation button can be selectively moved from a locked position where said upper and lower sections of said height adjustment column cannot move relative to each other, to an unlocked position where said upper and lower sections of said height adjustable column can move relative to each other, wherein said height adjustment column is actuated

50. The wheeled work chair of claim 40, wherein said push-off arm rest supporting mechanism is secured to said lower portion.

51. The wheeled work chair of claim 40, comprising means to lock and unlock said upper and lower portions of said wheeled work chair; wherein when locked, relative change in elevation of said upper portion relative to said lower portion can be prevented, and when unlocked, relative change in elevation of said upper portion relative to said lower portion can be allowed; wherein said means comprises an actuation mechanism.

52. The wheeled work chair of claim 40, comprising means to lock and unlock said upper and lower portions of said wheeled work chair; wherein when locked, relative change in elevation between said upper portion and said lower portion can be prevented, and when unlocked, relative change in elevation between said upper portion and said lower portion can be allowed; wherein said means comprises a remote actuation mechanism;

wherein said remote actuation mechanism is supported on said push-off arm rest supporting mechanism and is so disposed that a person sitting on said chair seat can reach and move said remote actuation mechanism while keeping both hands on said push-off arm rest supporting mechanism.

53. The wheeled work chair of claim 40, wherein said base comprises at least two castors; wherein each castor swivels, and can contact and roll along a floor surface.

54. The wheeled work chair of claim 40, comprising a pivot comprising an horizontal axis; and a rotable back rest; wherein said rotable back rest can rotate about said pivot.

55. The wheeled work chair of claim 54, wherein said rotable back rest is adjustable in height relative to said chair seat.

56. The wheeled work chair of claim 40, wherein said support mechanism comprises a pivot comprising an horizontal axis; wherein said chair seat can rotate about said pivot.

57. The wheeled work chair of claim 41, wherein said spring comprises a movable resilient spring material; wherein when said upper portion of said wheeled work chair is moved toward said lower portion with sufficient force, said resilient spring material can be resiliently moved, wherein absent sufficient force, said resilient spring material can resiliently move resulting in moving said second portion away from said first portion, resulting in moving said seat support mechanism and correspondingly moving said chair seat away from said base.

* * * * *